US009504118B2

(12) United States Patent
Agarwal et al.

(10) Patent No.: US 9,504,118 B2
(45) Date of Patent: Nov. 22, 2016

(54) RESISTANCE MEASUREMENT OF A RESISTOR IN A BIPOLAR JUNCTION TRANSISTOR (BJT)-BASED POWER STAGE

(71) Applicant: Cirrus Logic, Inc., Austin, TX (US)

(72) Inventors: Shatam Agarwal, Austin, TX (US); Rahul Singh, Austin, TX (US)

(73) Assignee: CIRRUS LOGIC, INC., Austin, TX (US)

( * ) Notice: Subject to any disclaimer, the term of this patent is extended or adjusted under 35 U.S.C. 154(b) by 31 days.

(21) Appl. No.: 14/624,475

(22) Filed: Feb. 17, 2015

(65) Prior Publication Data

US 2016/0242258 A1 Aug. 18, 2016

(51) Int. Cl.
*H05B 33/08* (2006.01)

(52) U.S. Cl.
CPC ..... *H05B 33/0887* (2013.01); *H05B 33/0815* (2013.01)

(58) Field of Classification Search
CPC ..... H05B 33/0815; H05B 33/0818; H05B 37/029; H05B 37/02; H05B 41/3925; H05B 41/391; H05B 41/2828; H05B 33/0803
USPC ..... 315/291, 193, 308, 307; 363/59; 323/282
See application file for complete search history.

(56) References Cited

U.S. PATENT DOCUMENTS

| | | | |
|---|---|---|---|
| 3,660,751 | A | 5/1972 | Bullinga |
| 3,790,878 | A | 2/1974 | Brokaw |
| 4,322,785 | A | 3/1982 | Walker |
| 4,339,671 | A | 7/1982 | Park et al. |
| 4,342,956 | A | 8/1982 | Archer |
| 4,399,500 | A | 8/1983 | Clarke et al. |
| 4,410,810 | A | 10/1983 | Christen |
| 4,493,017 | A | 1/1985 | Kammiller et al. |
| 4,585,986 | A | 4/1986 | Dyer |
| 4,629,971 | A | 12/1986 | Kirk |
| 4,675,547 | A | 6/1987 | Eichenwald |
| 4,677,366 | A | 6/1987 | Wilkinson et al. |

(Continued)

FOREIGN PATENT DOCUMENTS

| | | |
|---|---|---|
| EP | 0536535 A1 | 4/1993 |
| EP | 0636889 A1 | 2/1995 |

(Continued)

OTHER PUBLICATIONS

International Search Report and Written Opinion mailed Sep. 18, 2014, during examination of PCT/US2014/038490, cited references previously disclosed on Sep. 29, 2014.

(Continued)

*Primary Examiner* — Douglas W Owens
*Assistant Examiner* — Syed M Kaiser
(74) *Attorney, Agent, or Firm* — Norton Rose Fulbright US LLP

(57) ABSTRACT

A bipolar junction transistor (BJT) may be used in a power stage DC-to-DC converter, such as a converter in LED-based light bulbs. The power stage may be operated by a controller to maintain a desired current output to the LED load. A resistor may be coupled to the BJT through a switch at the emitter of the BJT. The switch may regulate operation of the BJT by allowing current flow to ground through the resistor. The controller may perform measurements of the resistor to allow higher accuracy determinations of the current through the BJT and thus improve regulation of current to the LED load.

25 Claims, 10 Drawing Sheets

(56) References Cited

U.S. PATENT DOCUMENTS 4,683,529 A 7/1987 Bucher, II
4,737,658 A 4/1988 Kronmuller et al.
4,739,462 A 4/1988 Farnsworth et al.
4,937,728 A 6/1990 Leonardi
4,940,929 A 7/1990 Williams
4,970,635 A 11/1990 Shekhawat et al.
4,977,366 A 12/1990 Powell
5,001,620 A 3/1991 Smith
5,003,454 A 3/1991 Bruning
5,055,746 A 10/1991 Hu et al.
5,109,185 A 4/1992 Ball
5,173,643 A 12/1992 Sullivan et al.
5,264,780 A 11/1993 Bruer et al.
5,278,490 A 1/1994 Smedley
5,383,109 A 1/1995 Maksimovic et al.
5,424,665 A 6/1995 Sueri et al.
5,424,932 A 6/1995 Inou et al.
5,430,635 A 7/1995 Liu
5,479,333 A 12/1995 McCambridge et al.
5,481,178 A 1/1996 Wilcox et al.
5,486,781 A 1/1996 Im
5,565,761 A 10/1996 Hwang
5,638,265 A 6/1997 Gabor
5,691,890 A 11/1997 Hyde
5,747,977 A 5/1998 Hwang
5,757,635 A 5/1998 Seong
5,764,039 A 6/1998 Choi et al.
5,783,909 A 7/1998 Hochstein
5,798,635 A 8/1998 Hwang et al.
5,808,453 A 9/1998 Lee et al.
5,874,725 A 2/1999 Yamaguchi
5,960,207 A 9/1999 Brown
5,994,885 A 11/1999 Wilcox et al.
6,043,633 A 3/2000 Lev et al.
6,084,450 A 7/2000 Smith et al.
6,091,233 A 7/2000 Hwang et al.
6,160,724 A 12/2000 Hemena et al.
6,229,292 B1 5/2001 Redl et al.
6,259,614 B1 7/2001 Ribarich et al.
6,300,723 B1 10/2001 Wang et al.
6,304,066 B1 10/2001 Wilcox et al.
6,304,473 B1 10/2001 Telefus et al.
6,343,026 B1 1/2002 Perry
6,356,040 B1 3/2002 Preis et al.
6,445,600 B2 9/2002 Ben-Yaakov
6,469,484 B2 10/2002 L'Hermite et al.
6,510,995 B2 1/2003 Muthu et al.
6,531,854 B2 3/2003 Hwang
6,580,258 B2 6/2003 Wilcox et al.
6,583,550 B2 6/2003 Iwasa et al.
6,628,106 B1 9/2003 Batarseh et al.
6,657,417 B1 12/2003 Hwang
6,661,182 B2 12/2003 Sridharan
6,696,803 B2 2/2004 Tao et al.
6,724,174 B1 4/2004 Esteves et al.
6,758,199 B2 7/2004 Masters et al.
6,768,655 B1 7/2004 Yang et al.
6,781,351 B2 8/2004 Mednik et al.
6,839,247 B1 1/2005 Yang et al.
6,882,552 B2 4/2005 Telefus et al.
6,894,471 B2 5/2005 Corva et al.
6,933,706 B2 8/2005 Shih
6,940,733 B2 9/2005 Schie et al.
6,944,034 B1 9/2005 Shteynberg et al.
6,956,750 B1 10/2005 Eason et al.
6,975,523 B2 12/2005 Kim et al.
6,980,446 B2 12/2005 Simada et al.
7,042,161 B1 5/2006 Konopka
7,072,191 B2 7/2006 Nakao et al.
7,099,163 B1 8/2006 Ying
7,161,816 B2 1/2007 Shteynberg et al.
7,221,130 B2 5/2007 Ribeiro et al.
7,224,206 B2 5/2007 Pappalardo et al.
7,233,135 B2 6/2007 Noma et al.
7,266,001 B1 9/2007 Notohamiprodjo et al.
7,292,013 B1 11/2007 Chen et al.
7,295,452 B1 11/2007 Liu
7,411,379 B2 8/2008 Chu et al.
7,414,371 B1 8/2008 Choi et al.
7,439,810 B2 10/2008 Manicone et al.
7,449,841 B2 11/2008 Ball
7,554,473 B2 6/2009 Melanson
7,567,091 B2 7/2009 Farnworth et al.
7,606,532 B2 10/2009 Wuidart
7,667,986 B2 2/2010 Artusi et al.
7,684,223 B2 3/2010 Wei
7,719,246 B2 5/2010 Melanson
7,719,248 B1 5/2010 Melanson
7,746,043 B2 6/2010 Melanson
7,804,480 B2 9/2010 Jeon et al.
7,834,553 B2 11/2010 Hunt et al.
7,859,488 B2 12/2010 Kimura
7,872,883 B1 1/2011 Elbanhawy
7,894,216 B2 2/2011 Melanson
8,008,898 B2 8/2011 Melanson et al.
8,169,806 B2 5/2012 Sims et al.
8,193,717 B2 6/2012 Leiderman
8,222,772 B1 7/2012 Vinciarelli
8,242,764 B2 8/2012 Shimizu et al.
8,248,145 B2 8/2012 Melanson
8,369,109 B2 2/2013 Niedermeier et al.
8,441,220 B2 5/2013 Imura
8,536,799 B1 9/2013 Grisamore et al.
8,610,364 B2 12/2013 Melanson et al.
2002/0082056 A1 6/2002 Mandai et al.
2002/0171467 A1* 11/2002 Worley, Sr. ..... H05B 33/0815 327/514
2003/0090252 A1 5/2003 Hazucha
2003/0111969 A1 6/2003 Konishi et al.
2003/0160576 A1 8/2003 Suzuki
2003/0174520 A1 9/2003 Bimbaud
2003/0214821 A1 11/2003 Giannopoulos et al.
2003/0223255 A1 12/2003 Ben-Yaakov et al.
2004/0046683 A1 3/2004 Mitamura et al.
2004/0196672 A1 10/2004 Amei
2005/0057237 A1 3/2005 Clavel
2005/0207190 A1 9/2005 Gritter
2005/0231183 A1 10/2005 Li et al.
2005/0270813 A1 12/2005 Zhang et al.
2005/0275354 A1 12/2005 Hausman et al.
2006/0013026 A1 1/2006 Frank et al.
2006/0022648 A1 2/2006 Ben-Yaakov et al.
2006/0214603 A1 9/2006 Oh et al.
2007/0103949 A1 5/2007 Tsuruya
2007/0120506 A1* 5/2007 Grant ..... H05B 33/0851 315/312
2007/0182347 A1 8/2007 Shteynberg et al.
2008/0018261 A1 1/2008 Kastner
2008/0043504 A1 2/2008 Ye et al.
2008/0062584 A1 3/2008 Freitag et al.
2008/0062586 A1 3/2008 Apfel
2008/0117656 A1 5/2008 Clarkin
2008/0130336 A1 6/2008 Taguchi
2008/0175029 A1 7/2008 Jung et al.
2008/0259655 A1 10/2008 Wei et al.
2008/0278132 A1 11/2008 Kesterson et al.
2008/0310194 A1 12/2008 Huang et al.
2009/0040796 A1* 2/2009 Lalithambika .... H02M 3/33507 363/21.17
2009/0059632 A1 3/2009 Li et al.
2009/0067204 A1 3/2009 Ye et al.
2009/0108677 A1 4/2009 Walter et al.
2009/0184665 A1 7/2009 Ferro
2009/0295300 A1 12/2009 King
2010/0110682 A1* 5/2010 Jung ..... H05B 33/0869 362/249.02
2010/0128501 A1 5/2010 Huang et al.
2010/0202165 A1 8/2010 Zheng et al.
2010/0238689 A1 9/2010 Fei et al.
2010/0244793 A1 9/2010 Caldwell
2011/0110132 A1 5/2011 Rausch et al.
2011/0199793 A1 8/2011 Kuang et al.
2011/0276938 A1 11/2011 Perry et al.
2011/0291583 A1 12/2011 Shen

(56) References Cited

U.S. PATENT DOCUMENTS

| | | | | |
|---|---|---|---|---|
| 2011/0298442 | A1 | 12/2011 | Waltisperger et al. | |
| 2011/0309760 | A1 | 12/2011 | Beland et al. | |
| 2012/0062131 | A1 | 3/2012 | Choi et al. | |
| 2012/0146540 | A1 | 6/2012 | Khayat et al. | |
| 2012/0158188 | A1* | 6/2012 | Madala | G01F 23/243 700/276 |
| 2012/0161857 | A1* | 6/2012 | Sakaguchi | H02M 3/07 327/536 |
| 2012/0169240 | A1* | 7/2012 | Macfarlane | H02M 1/4225 315/152 |
| 2012/0182003 | A1 | 7/2012 | Flaibani et al. | |
| 2012/0187997 | A1 | 7/2012 | Liao et al. | |
| 2012/0248998 | A1 | 10/2012 | Yoshinaga | |
| 2012/0286843 | A1 | 11/2012 | Kurokawa | |
| 2012/0313598 | A1* | 12/2012 | Arp | H05B 33/0815 323/282 |
| 2012/0320640 | A1 | 12/2012 | Baurle et al. | |
| 2013/0088902 | A1 | 4/2013 | Dunipace | |
| 2013/0107595 | A1 | 5/2013 | Gautier et al. | |
| 2013/0181635 | A1 | 7/2013 | Ling | |
| 2013/0293135 | A1* | 11/2013 | Hu | H05B 33/0815 315/224 |
| 2014/0218978 | A1 | 8/2014 | Heuken et al. | |

FOREIGN PATENT DOCUMENTS

| | | | |
|---|---|---|---|
| EP | 1213823 | A2 | 6/2002 |
| EP | 1289107 | A2 | 3/2003 |
| EP | 1962263 | A2 | 8/2008 |
| EP | 2232949 | A2 | 9/2010 |
| EP | 2257124 | A1 | 12/2010 |
| JP | 2008053181 | A | 3/2008 |
| WO | 01/84697 | A2 | 11/2001 |
| WO | 2004051834 | A1 | 6/2004 |
| WO | 2006013557 | A2 | 2/2006 |
| WO | 2006/022107 | A1 | 3/2006 |
| WO | 2007016373 | A2 | 2/2007 |
| WO | 2008004008 | A2 | 1/2008 |
| WO | 2008152838 | A1 | 12/2008 |
| WO | 2010011971 | A1 | 1/2010 |
| WO | 2010065598 | A2 | 6/2010 |
| WO | 2011008635 | A1 | 1/2011 |

OTHER PUBLICATIONS

International Search Report and Written Opinion mailed Sep. 16, 2014, during examination of PCT/US2014/038507, cited references previously disclosed on Sep. 29, 2014.

Severns, A New Improved and Simplified Proportional Base Drive Circuit, Proceedings of PowerCon 6, May 1979.

Ivanovic, Zelimir, "A low consumption proportional base drive circuit design for switching transistors", Proceedings of The Fifth International PCI '82 Conference: Sep. 28-30, 1982, Geneva, Switzerland.

Bell, David, "Designing optimal base drive for high voltage switching transistors", Proceeding of PowerCon7, 1980.

Marcelo Godoy Simões, "Power Bipolar Transistors", Chapter 5, Academic Press 2001, pp. 63-74.

Varga, L.D. and Losic, N.A., "Design of a high-performance floating power BJT driver with proportional base drive," Industry Applications Society Annual Meeting, 1989., Conference Record of the Oct. 1-5, 1989, IEEE, vol. I, pp. I186, 1189.

Skanadore, W.R., "Toward an understanding and optimal utilization of third-generation bipolar switching transistors", 1982 IEEE.

IC datasheet STR-S6707 through STR-S6709 by Sanken, copyright 1994, Allegro MicroSystems, Inc.

Avant et al., "Analysis of magnetic proportional drive circuits for bipolar junction transistors" PESC 1985, pp. 375-381.

Maksimovic, et al, Impact of Digital Control in Power Electronics, International Symposium on Power Semiconductor Devices and ICS, 2004, pp. 2-22, Boulder, Colorado, USA.

Fairchild Semiconductor, Ballast Control IC, FAN 7711, Rev. 1.0.3, 2007, pp. 1-23, San Jose, California, USA.

Yao, Gang et al, Soft Switching Circuit for Interleaved Boost Converters, IEEE Transactions on Power Electronics, vol. 22, No. 1, Jan. 2007, pp. 1-8, Hangzhou China.

STMicroelectronics, Transition Mode PFC Controller, Datasheet L6562, Rev. 8, Nov. 2005, pp. 1-16, Geneva, Switzerland.

Zhang, Wanfeng et al, A New Duty Cycle Control Strategy for Power Factor Correction and FPGA Implementation, IEEE Transactions on Power Electronics, vol. 21, No. 6, Nov. 2006, pp. 1-10, Kingston, Ontario, Canada.

STMicroelectronics, Power Factor Connector L6561, Rev 16, Jun. 2004, pp. 1-13, Geneva, Switzerland.

Texas Instruments, Avoiding Audible Noise at Light Loads When Using Leading Edge Triggered PFC Converters, Application Report SLUA309A, Mar. 2004-Revised Sep. 2004, pp. 1-4, Dallas, Texas, USA.

Texas Instruments, Startup Current Transient of the Leading Edge Triggered PFC Controllers, Application Report SLUA321, Jul. 2004, pp. 1-4, Dallas, Texas, USA.

Texas Instruments, Current Sense Transformer Evaluation UCC3817, Application Report SLUA308, Feb. 2004, pp. 1-3, Dallas, Texas, USA.

Texas Instruments, BiCMOS Power Factor Preregulator Evaluation Board UCC3817, User's Guide, SLUU077C, Sep. 2000—Revised Nov. 2002, pp. 1-10, Dallas, Texas, USA.

Texas Instruments, Interleaving Continuous Conduction Mode PFC Controller, UCC28070, SLUS794C, Nov. 2007—Revised Jun. 2009, pp. 1-45, Dallas, Texas, USA.

Texas Instruments, 350-W Two-Phase Interleaved PFC Pre-regulator Design Review, Application Report SLUA369B, Feb. 2005—Revised Mar. 2007, pp. 1-22, Dallas, Texas, USA.

Texas Instruments, Average Current Mode Controlled Power Factor Correction Converter using TMS320LF2407A, Application Report SPRA902A, Jul. 2005, pp. 1-15, Dallas, Texas, USA.

Texas Instruments, Transition Mode PFC Controller, UCC28050, UCC28051, UCC38050, UCC38051, Application Note SLUS515D, Sep. 2002—Revised Jul. 2005, pp. 1-28, Dallas, Texas, USA.

Unitrode, High Power-Factor Preregulator, UC1852, UC2852, UC3852, Feb. 5, 2007, pp. 1-8, Merrimack, Maine, USA.

Unitrode, Optimizing Performance in UC3854 Power Factor Correction Applications, Design Note ON 39E, 1999, pp. 1-6, Merrimack, Maine, USA.

On Semiconductor Four Key Steps to Design a Continuous Conduction Mode PFC Stage Using the NCP1653, Application Note AND8184/D, Nov. 2004, pp. 1-8, Phoenix, AZ, USA.

Unitrode, BiCMOS Power Factor Preregulator, Texas Instruments, UCC2817, UCC2818, UCC3817, UCC3818, SLUS3951, Feb. 2000—Revised Feb. 2006, pp. 1-25, Dallas, Texas, USA.

Unitrode, UC3854AIB and UC3855A!B Provide Power Limiting with Sinusoidal Input Current for PFC Front Ends, SLUA196A, Design Note DN-66, Jun. 1995—Revised Nov. 2001, pp. 1-6, Merrimack, Maine, USA.

Unitrode, Programmable Output Power Factor Preregulator, UCC2819, UCC3819, SLUS482B, Apr. 2001—Revised Dec. 2004, pp. 1-16, Merrimack, Maine, USA.

Texas Instruments, UCC281019, 8-Pin Continuous Conduction Mode (CCM) PFC Controller, SLU828B, Revised Apr. 2009, pp. 1-48, Dallas, Texas, USA.

http://toolbarpdf.com/docs/functions-and-features-of=inverters.html, Jan. 20, 2011, pp. 1-8.

Zhou, Jinghai, et al, Novel Sampling Algorithm for DSP Controlled 2kW PFC Converter, IEEE Transactions on Power Electronics, vol. 16, No. 2, Mar. 2001, pp. 1-6, Hangzhou, China.

Mammano, Bob, Current Sensing Solutions for Power Supply Designers, Texas Instruments, 2001, pp. 1-36, Dallas, Texas, USA.

Fairchild Semiconductor, Ballast Control IC FAN7532, Rev. 1.0.3, Jun. 2006, pp. 1-16, San Jose, California, USA.

Fairchild Semiconductor, Simple Ballast Controller, FAN7544, Rev. 1.0.0, Sep. 21, 2004, pp. 1-14, San Jose, California, USA.

Texas Instruments, High Performance Power Factor Preregulator, UC2855A/B and UC3855A/B, SLUS328B, Jun. 1998, Revised Oct. 2005, pp. 1-14, Dallas, TX, USA.

(56) References Cited

OTHER PUBLICATIONS

Balogh, Laszlo, et al, Power-Factor Correction with Interleaved Boost Converters in Continuous-Inductr-Current Mode, 1993, IEEE, pp. 168-174, Switzerland.
Cheng, Hung L., et al, A Novel Single-Stage High-Power-Factor Electronic Ballast with Symmetrical Topology, Power Electronics and Motion Control Conference, 2006. IPEMC 2006. CES/IEEE 5th International, Aug. 14-16, 2006, vol. 50, No. 4, Aug. 2003, pp. 759-766, Nat. Ilan Univ., Taiwan.
Fairchild Semiconductor. Theory and Application of the ML4821 Average Current Mode PFC Controllerr, Fairchild Semiconductor Application Note 42030. Rev. 1.0, Oct. 25, 2000, pp. 1-19, San Jose, California, USA.
Garcia, 0., et al, High Efficiency PFC Converter to Meet EN610000302 and A14, Industrial Electronics, 2002. ISIE 2002. Proceedings of the 2002 IEEE International Symposium, vol. 3, pp. 975-980, Div. de Ingenieria Electronica, Univ. Politecnica de Madrid, Spain.
Infineon Technologies AG, Standalone Power Factor Correction (PFC) Controller in Continuous Conduction Mode (CCM), Infineon Power Management and Supply, CCM-PFC, ICE2PCS01, ICE2PCS01 G, Version 2.1, Feb. 6, 2007, p. 1-22, Munchen, Germany.
Lu, et al, Bridgeless PFC Implementation Using One Cycle Control Technique, International Rectifier, 2005, pp. 1-6, Blacksburg, VA, USA.
Brown, et al, PFC Converter Design with IR1150 One Cycle Control IC, International Rectifier, Application Note AN-1 077, pp. 1-18, El Segundo CA, USA.
International Rectifer, PFC One Cycle Control PFC IC, International Rectifier, Data Sheet No. PD60230 rev. C, IR1150(S)(PbF), IR11501(S)(PbF), Feb. 5, 2007, pp. 1-16, El Segundo, CA, USA.
International Rectifier, IRAC1150=300W Demo Board, User's Guide, Rev 3.0, International Rectifier Computing and Communications SBU—AC-DC Application Group, pp. 1-18, Aug. 2, 2005, El Segundo, CO USA.
Lai, Z., et al, A Family of Power-Factor-Correction Controller, Applied Power Electronics Conference and Exposition, 1997. APEC '97 Conference Proceedings 1997., Twelfth Annual, vol. 1, pp. 66-73, Feb. 23-27, 1997, Irvine, CA.
Lee, P, et al, Steady-State Analysis of an Interleaved Boost Converter with Coupled Inductors, IEEE Transactions on Industrial Electronics, vol. 47, No. 4, Aug. 2000, pp. 787-795, Hung Hom, Kowloon, Hong Kong.
Linear Technology, Single Switch PWM Controller with Auxiliary Boost Converter, Linear Technology Corporation, Data Sheet LT 1950, pp. 1-20, Milpitas, CA, USA.
Linear Technology, Power Factor Controller, Linear Technology Corporation, Data Sheet LT1248, pp. 1-12, Milpitas, CA, USA.
Supertex, Inc., HV9931 Unity Power Factor LED Lamp Driver, Supertex, Inc., Application Note AN-H52, 2007, pp. 1-20, Sunnyvale, CA, USA.
Ben-Yaakov, et al, The Dynamics of a PWM Boost Converter with Resistive Input, IEEE Transactions on Industrial Electronics, vol. 46., No. 3, Jun. 1999, pp. 1-8, Negev, Beer-Sheva, Israel.
Erickson, Robert W., et al, Fundamentals of Power Electronics, Second Edition, Chapter 6, 2001, pp. 131-184, Boulder CO, USA.
STMicroelectronics, CFL/TL Ballast Driver Preheat and Dimming L6574, Sep. 2003, pp. 1-10, Geneva, Switzerland.
Fairchild Semiconductor, 500W Power-Factor-Corrected (PFC) Converter Design with FAN4810, Application Note 6004, Rev. 1.0.1, Oct. 31,2003, pp. 1-14, San Jose, CA, USA.
Fairfield Semiconductor, Power Factor Correction (PFC) Basics, Application Note 42047, Rev. 0.9.0, Aug. 19, 2004, pp. 1-11, San Jose, CA, USA.
Fairchild Semiconductor, Design of Power Factor Correction Circuit Using FAN7527B, Application Note AN4121, Rev. 1.0.1, May 30,2002, pp. 1-12, San Jose, CA, USA.
Fairchild Semiconductor, Low Start-Up Current PFC/PWM Controller Combos FAN4800, Rev. 1.0.6, Nov. 2006, pp. 1-20, San Jose, CA, USA.
Prodic, Aleksander, Compensator Design and Stability Assessment for Fast Voltage Loops of Power Factor Correction Rectifiers, IEEE Transactions on Power Electronics, vol. 22, Issue 5, Sep. 2007, pp. 1719-1730, Toronto, Canada.
Fairchild Semiconductor, ZVS Average Current PFC Controller FAN 4822, Rev. 1.0.1, Aug. 10, 2001, pp. 1-10, San Jose, CA, USA.
Prodic, et al, Dead-Zone Digital Controller for Improved Dynamic Response of Power Factor Preregulators, Applied Power Electronics Conference and Exposition, 2003, vol. 1, pp. 382-388, Boulder CA, USA.
Philips Semiconductors, 90W Resonant SMPS with TEA 1610 Swing Chip, Application Note AN99011, Sep. 14, 1999, pp. 1-28, The Netherlands.
Fairchild Semiconductor, Power Factor Correction Controller FAN7527B, Aug. 16, 2003, pp. 1-12, San Jose, CA, USA.
On Semiconductor, Power Factor Controller for Compact and Robust, Continuous Conduction Mode Pre-Converters, NCP1654, Mar. 2007, Rev. PO, pp. 1-10, Denver, CO, USA.
Fairchild Semicondctor, Simple Ballast Controller, KA7541, Rev. 1.0.3, Sep. 27, 2001, pp. 1-14, San Jose, CA, USA.
Fairchild Semiconductor, Power Factor Controller, ML4812, Rev. 1.0.4, May 31, 2001, pp. 1-18, San Jose, CA, USA.
Prodic, et al, Digital Controller for High-Frequency Rectifiers with Power Factor Correction Suitable for On-Chip Implementation, Power Conversion Conference-Nagoya, 2007. PCC '07, Apr. 2-5, 2007, pp. 1527-1531, Toronto, Canada.
Freescale Semiconductor, Dimmable Light Ballast with Power Factor Correction, Designer Reference Manual, DRM067, Rev. 1, Dec. 2005, M68HC08 Microcontrollers, pp. 1-72, Chandler, AZ, USA.
Freescale Semiconductor, Design of Indirect Power Factor Correction Using 56F800/E, Freescale Semiconductor Application Note, AN1965, Rev. 1, Jul. 2005, pp. 1-20, Chandler, AZ, USA.
Freescale Semiconductor, Implementing PFC Average Current Mode Control using the MC9S12E128, Application Note AN3052, Addendum to Reference Design Manual DRM064, Rev. 0, Nov. 2005, pp. 1-8, Chandler, AZ, USA.
Hirota, et al, Analysis of Single Switch Delta-Sigma Modulated Pulse Space Modulation PFC Converter Effectively Using Switching Power Device, Power Electronics Specialists Conference, 2002. pesc 02. 2002 IEEE 33rd Annual, vol. 2, pp. 682-686, Hyogo Japan.
Madigan, et al, Integrated High-Quality Rectifier-Regulators, Industrial Electronics, IEEE Transactions, vol. 46, Issue 4, pp. 749-758, Aug. 1999, Cary, NC, USA.
Renesas, Renesas Technology Releases Industry's First Critical-Conduction-Mode Power Factor Correction Control IC Implementing Interleaved Operations, R2A20112, pp. 1-4, Dec. 18, 2006, Tokyo, Japan.
Renesas, PFC Control IC R2A20111 Evaluation Board, Application Note R2A20111 EVB, all pages, Feb. 2007, Rev. 1.0, pp. 1-39, Tokyo, Japan.
Miwa, et al, High Efficiency Power Factor Correction Using Interleaving Techniques, Applied Power Electronics Conference and Exposition, 1992. APEC '92. Conference Proceedings 1992., Seventh Annual, Feb. 23-27, 1992, pp. 557-568, MIT, Cambridge, MA, USA.
Noon, Jim, High Performance Power Factor Preregulator UC3855A!B, Texas Instruments Application Report, SLUA146A, May 1996—Revised Apr. 2004, pp. 1-35, Dallas TX, USA.
NXP Semiconductors, TEA1750, GreenChip III SMPS Control IC Product Data Sheet, Rev.01, Apr. 6, 2007, pp. 1-29, Eindhoven, The Netherlands.
Turchi, Joel, Power Factor Correction Stages Operating in Critical Conduction Mode, ON Semiconductor, Application Note AND8123/D, Sep. 2003—Rev. 1 , pp. 1-20, Denver, CO, USA.
On Semiconductor, Greenline Compact Power Factor Controller: Innovative Circuit for Cost Effective Solutions, MC33260, Semiconductor Components Industries, Sep. 2005—Rev. 9, pp. 1-22, Denver, CO, USA.

(56) References Cited

OTHER PUBLICATIONS

On Semiconductor, Enhanced, High Voltage and Efficient Standby Mode, Power Factor Controller, NCP1605, Feb. 2007, Rev. 1, pp. 1-32, Denver, CO, USA.
On Semiconductor, Cost Effective Power Factor Controller, NCP1606, Mar. 2007, Rev. 3, pp. 1-22, Denver, CO, USA.
Renesas, Power Factor Correction Controller IC, HA16174P/FP, Rev. 1.0, Jan. 6, 2006, pp. 1-38, Tokyo, Japan.
Seidel, et al, A Practical Comparison Among High-Power-Factor Electronic Ballasts with Similar Ideas, IEEE Transactions on Industry Applications, vol. 41, No. 6, Nov./Dec. 2005, pp. 1574-1583, Santa Maria, Brazil.
STMicroelectronics, Electronic Ballast with PFC using L6574 and L6561. Application Note AN993, May 2004, pp. 1-20, Geneva, Switzerland.
STMicroelectronics, Advanced Transition-Mode PFC Controller L6563 and L6563A, Mar. 2007, pp. 1-40, Geneva, Switzerland.
Su, et al, "Ultra Fast Fixed-Frequency Hysteretic Buck Converter with Maximum Charging Current Control and Adaptive Delay Compensation for DVS Applications", IEEE Journal of Solid-Slate Circuits, vol. 43, No. 4, Apr. 2008, pp. 815-822, Hong Kong University of Science and Technology, Hong Kong, China.
Wong, et al, "Steady State Analysis of Hysteretic Control Buck Converters", 2008 13th International Power Electronics and Motion Control Conference (EPE-PEMC 2008), pp. 400-404, 2008, National Semiconductor Corporation, Power Management Design Center, Hong Kong, China.
Zhao, et al, Steady-State and Dynamic Analysis of a Buck Converter Using a Hysteretic PWM Control, 2004 35th Annual IEEE Power Electronics Specialists Conference, pp. 3654-3658, Department of Electrical & Electronic Engineering, Oita University, 2004, Oita, Japan.
International Search Report, PCT/US2012/069942, European Patent Office, Jul. 21, 2014, pp. 1-5.
Written Opinion, PCT/US2012/069942, European Patent Office, Jul. 21, 2014, pp. 1-8.
International Search Report, PCT/US2014/021921, European Patent Office, Jun. 23, 2014, pp. 1-3.
Written Opinion, PCT/US2014/021921, European Patent Office, Jun. 23, 2014, pp. 1-5.

* cited by examiner

RESISTANCE MEASUREMENT OF A RESISTOR IN A BIPOLAR JUNCTION TRANSISTOR (BJT)-BASED POWER STAGE

CROSS-REFERENCE TO RELATED APPLICATIONS

This application is related by subject matter to U.S. patent application Ser. No. 14/280,539 to John Melanson et al. filed May 16, 2014 and entitled "Charge Pump-Based Drive Circuitry for Bipolar Junction Transistor (BJT)-based Power Supply" and is related by subject matter to U.S. patent application Ser. No. 14/280,474 to Ramin Zanbaghi et al. filed May 16, 2014 and entitled "Single Pin Control of Bipolar Junction Transistor (BJT)-based Power Stage," and is related by subject matter to U.S. patent application Ser. No. 14/341,984 to Melanson et al. filed Jul. 28, 2014, and entitled "Compensating for a Reverse Recovery Time Period of the Bipolar Junction Transistor (BJT) in Switch-Mode Operation of a Light-Emitting Diode (LED)-based Bulb," and is related by subject matter to U.S. patent application Ser. No. 13/715,914 to Siddharth Maru filed Dec. 14, 2012 and entitled "Multi-Mode Flyback Control For a Switching Power Converter," and is related to U.S. patent application Ser. No. 14/444,087 to Siddharth Maru et al. filed Jul. 28, 2014, and entitled "Two Terminal Drive of Bipolar Junction Transistor (BJT) for Switch-Mode Operation of a Light Emitting Diode (LED)-Based Bulb," each of which is incorporated by reference.

FIELD OF THE DISCLOSURE

The instant disclosure relates to power supply circuitry. More specifically, this disclosure relates to power supply circuitry for lighting devices.

BACKGROUND

Alternative lighting devices to replace incandescent light bulbs differ from incandescent light bulbs in the manner that energy is converted to light. Incandescent light bulbs include a metal filament. When electricity is applied to the metal filament, the metal filament heats up and glows, radiating light into the surrounding area. The metal filament of conventional incandescent light bulbs generally has no specific power requirements. That is, any voltage and any current may be applied to the metal filament, because the metal filament is a passive device. Although the voltage and current need to be sufficient to heat the metal filament to a glowing state, any other characteristics of the delivered energy to the metal filament do not affect operation of the incandescent light bulb. Thus, conventional line voltages in most residences and commercial buildings are sufficient for operation of the incandescent bulb.

However, alternative lighting devices, such as compact fluorescent light (CFL) bulbs and light emitting diode (LED)-based bulbs, contain active elements that interact with the energy supply to the light bulb. These alternative devices are desirable for their reduced energy consumption, but the alternative devices have specific requirements for the energy delivered to the bulb. For example, compact fluorescent light (CFL) bulbs often have an electronic ballast designed to convert energy from a line voltage to a very high frequency for application to a gas contained in the CFL bulb, which excites the gas and causes the gas to glow. In another example, light emitting diode (LEDs)-based bulbs include a power stage designed to convert energy from a line voltage to a low voltage for application to a set of semiconductor devices, which excites electrons in the semiconductor devices and causes the semiconductor devices to glow. Thus, to operate either a CFL bulb or LED-based bulb, the line voltage must be converted to an appropriate input level for the lighting device of a CFL bulb or LED-based bulb. Conventionally, a power stage is placed between the lighting device and the line voltage to provide this conversion. Although a necessary component, this power stage increases the cost of the alternate lighting device relative to an incandescent bulb.

One conventional power stage configuration is the buck-boost power stage. FIG. 1 is a circuit schematic showing a buck-boost power stage for a light-emitting diode (LED)-based bulb. An input node 102 receives an input voltage, such as line voltage, for a circuit 100. The input voltage is applied across an inductor 104 under control of a switch 110 coupled to ground. When the switch 110 is activated, current flows from the input node 102 to the ground and charges the inductor 104. A diode 106 is coupled between the inductor 104 and light emitting diodes (LEDs) 108. When the switch 110 is deactivated, the inductor 104 discharges into the light emitting diodes (LEDs) 108 through the diode 106. The energy transferred to the light emitting diodes (LEDs) 108 from the inductor 104 is converted to light by LEDs 108.

The conventional power stage configuration of FIG. 1 provides limited control over the conversion of energy from a source line voltage to the lighting device. The only control available is through operation of the switch 110 by a controller. However, that controller would require a separate power supply or power stage circuit to receive a suitable voltage supply from the line voltage. Additionally, the switch 110 presents an additional expense to the light bulb containing the power stage. Because the switch 110 is coupled to the line voltage, which may be approximately 120-240 Volts RMS with large variations, the switch 110 must be a high voltage switch, which are large, difficult to incorporate into small bulbs, and expensive.

Shortcomings mentioned here are only representative and are included simply to highlight that a need exists for improved power stages, particularly for lighting devices and consumer-level devices. Embodiments described here address certain shortcomings but not necessarily each and every one described here or known in the art.

SUMMARY

A bipolar junction transistor (BJT) may be used as a switch for controlling a power stage of a lighting device, such as a light-emitting diode (LED)-based light bulb. Bipolar junction transistors (BJTs) may be suitable for high voltage applications, such as for use in the power stage and for coupling to a line voltage. Further, bipolar junction transistors (BJTs) are lower cost devices than conventional high voltage field effect transistors (HV FETs). Thus, implementations of power stages having bipolar junction transistor (BJT) switches may be lower cost than power stage implementations having field effect transistor (FET) switches.

In certain embodiments, the BJT may be emitter-controlled through the use of a field-effect transistor (FET) switch attached to an emitter of the BJT. A controller may toggle the switch to inhibit or allow current flow through the BJT. A current flow through the BJT may be measured while the switch is in a conducting state through a current detect circuit coupled between the switch and a ground. The current detect circuit may include, for example, a resistor.

When current flows through the resistor a voltage develops across the resistor that may be measured by circuitry, such as an analog-to-digital converter (ADC). The accuracy of the current measurement performed by dividing the sensed voltage by the resistance of the resistor depends, in part, on an accurate measurement of the resistance value of the resistor. The resistance value of the resistor may be measured with circuits and methods described in detail below.

According to one embodiment, a method may include measuring a resistance value of a resistor coupled to an emitter of a bipolar junction transistor (BJT) in a power stage; switching on a control signal to operate a bipolar junction transistor (BJT) for a first time period to charge an energy storage device; switching off the control signal to operate the bipolar junction transistor (BJT) for a second time period to discharge the energy storage device to a load, wherein the measured resistance value is used to determine the first time period and the second time period; and/or repeating the steps of switching on and the switching off the bipolar junction transistor (BJT) to output a desired average current to the load.

In some embodiments, the step of measuring the resistance value of the resistor may include activating a switch coupled between a base of the bipolar junction transistor (BJT) and the resistor, applying a current through the switch to the resistor and to a ground, and/or measuring a voltage across the resistor at the applied current; the step of applying a current comprises applying a current from the forward base drive current source for the bipolar junction transistor (BJT); the step of measuring the resistance value of the resistor may include activating a switch coupled between a second resistor and the resistor, wherein the second resistor is coupled to a base of the bipolar junction transistor, applying a current through the switch to the resistor and to a ground, and/or measuring a voltage across the resistor at the applied current; the step of applying a current comprises applying a current from the forward base drive current source for the bipolar junction transistor (BJT); the power stage may include a flyback topology power stage; the power stage may include a buck-boost topology power stage; and/or the step of outputting the desired average current to the load comprises delivering a desired average current to a light emitting diode (LED)-based light bulb.

In certain embodiments, the method may also include measuring a second resistance value of the resistor; computing a final resistance value for the resistor as an average of the resistance value and the second resistance value; and/or calculating a peak current for the bipolar junction transistor (BJT) based, at least in part, on the measured resistance value.

According to another embodiment, an apparatus may include an integrated circuit (IC) configured to couple to a bipolar junction transistor (BJT), wherein the integrated circuit (IC) includes: a switch configured to couple to an emitter of the bipolar junction transistor (BJT), a resistor coupled to the switch and to a ground, and/or a controller coupled to the switch and configured to control delivery of power to a load by operating the switch based, at least in part, on a measured resistance of the resistor. In certain embodiments, the controller may be configured to perform the steps of measuring a resistance value of the resistor; switching on a control signal to activate the switch and operate the bipolar junction transistor (BJT) for a first time period to charge an energy storage device; switching off the control signal to deactivate the switch and operate the bipolar junction transistor (BJT) for a second time period to discharge the energy storage device to a load, wherein the measured resistance value is used to determine the first time period and the second time period; and/or repeating the steps of switching on and the switching off the bipolar junction transistor to output a desired average current to the load.

In some embodiments, the apparatus may include a current source, a second switch coupled to the resistor and coupled to the current source, an analog-to-digital converter (ADC), and/or a third switch coupled to the resistor and the analog-to-digital converter (ADC), and the controller may be configured to perform the step of measuring the resistance value of the resistor by performing the steps of: activating the second switch and the third switch to apply a current from the current source to the resistor, and/or receiving a measurement of a voltage across the resistor from the analog-to-digital converter (ADC).

In some embodiments, the apparatus may include a bleed path configured to couple to a base of the bipolar junction transistor (BJT), a current source, a second switch coupled to the bleed path and coupled to the resistor, an analog-to-digital converter (ADC), and/or a third switch coupled to the resistor and coupled to the analog-to-digital converter (ADC), and the controller may be configured to perform the step of measuring the resistance value of the resistor by performing the steps of: activating the second switch and the third switch to apply a current from the current source to the resistor, and/or receiving a measurement of a voltage across the resistor from the analog-to-digital converter (ADC).

In certain embodiments, the current source comprises a forward base current source configured to couple to a base of the bipolar junction transistor (BJT); the controller may be further configured to perform the step of measuring a second resistance value of the resistor; the controller may be further configured to perform the step of computing a final resistance value for the resistor as an average of the resistance value and the second resistance value; the apparatus may include a flyback topology power stage; the apparatus may include a buck-boost topology power stage; the controller may be further configured to perform the step of calculating a peak current for the bipolar junction transistor (BJT) based, at least in part, on the measured resistance value; and/or the step of outputting the desired average current to the load may include delivering a desired average current to a plurality of LEDs.

According to a further embodiment, an apparatus may include a lighting load comprising a plurality of light emitting diodes (LEDs); a bipolar junction transistor (BJT) comprising a base, an emitter, and a collector, wherein the collector of the bipolar junction transistor (BJT) is coupled to an input node; and an integrated circuit (IC) configured to couple to the bipolar junction transistor (BJT) through the base and the emitter. In certain embodiments, the integrated circuit may include a switch configured to couple to the emitter of the bipolar junction transistor (BJT); a resistor coupled to the switch and to a ground; an analog-to-digital converter (ADC) coupled to the resistor; and/or a controller coupled to the switch. The controller may be configured to perform the steps of measuring a resistance of the resistor through the analog-to-digital converter (ADC); and/or controlling delivery of power to the lighting load by operating the switch based, at least in part, on the measured resistance of the resistor.

In some embodiments, the integrated circuit may also include a current source, a second switch coupled to the resistor and coupled to the current source, and/or a third switch coupled to the resistor and the analog-to-digital converter (ADC), and the controller may be configured to perform the step of measuring the resistance value of the resistor by performing the steps of activating the second switch and the third switch to apply a current from the current source to the resistor, and/or receiving a measurement of a voltage across the resistor from the analog-to-digital converter (ADC).

In some embodiments, the integrated circuit may also include a bleed path configured to couple to a base of the bipolar junction transistor (BJT), a current source, a second switch coupled to the bleed path and coupled to the resistor, and/or a third switch coupled to the resistor and coupled to the analog-to-digital converter (ADC), and the controller may be configured to perform the step of measuring the resistance value of the resistor by performing the steps of: activating the second switch and the third switch to apply a current from the current source to the resistor, and/or receiving a measurement of a voltage across the resistor from the analog-to-digital converter (ADC).

In certain embodiments, the current source may include a forward base current source configured to couple to a base of the bipolar junction transistor (BJT).

The foregoing has outlined rather broadly certain features and technical advantages of embodiments of the present invention in order that the detailed description that follows may be better understood. Additional features and advantages will be described hereinafter that form the subject of the claims of the invention. It should be appreciated by those having ordinary skill in the art that the conception and specific embodiment disclosed may be readily utilized as a basis for modifying or designing other structures for carrying out the same or similar purposes. It should also be realized by those having ordinary skill in the art that such equivalent constructions do not depart from the spirit and scope of the invention as set forth in the appended claims. Additional features will be better understood from the following description when considered in connection with the accompanying figures. It is to be expressly understood, however, that each of the figures is provided for the purpose of illustration and description only and is not intended to limit the present invention.

BRIEF DESCRIPTION OF THE DRAWINGS

For a more complete understanding of the disclosed system and methods, reference is now made to the following descriptions taken in conjunction with the accompanying drawings.

DETAILED DESCRIPTION

A bipolar junction transistor (BJT) may control delivery of power to a lighting device, such as light emitting diodes (LEDs). The bipolar junction transistor (BJT) may be coupled to a high voltage source, such as a line voltage, and may control delivery of power to the LEDs. The bipolar junction transistor (BJT) is a low cost device that may reduce the price of alternative light bulbs. In some embodiments, a controller for regulating energy transfer from an input voltage, such as a line voltage, to a load, such as the LEDs, may be coupled to the BJT through two terminals. For example, the controller may regulate energy transfer by coupling to a base of the BJT and an emitter of the BJT. The controller may obtain input from the base and/or emitter of the BJT and apply control signals to circuitry configured to couple to a base and/or emitter of the BJT.

Figure 1:
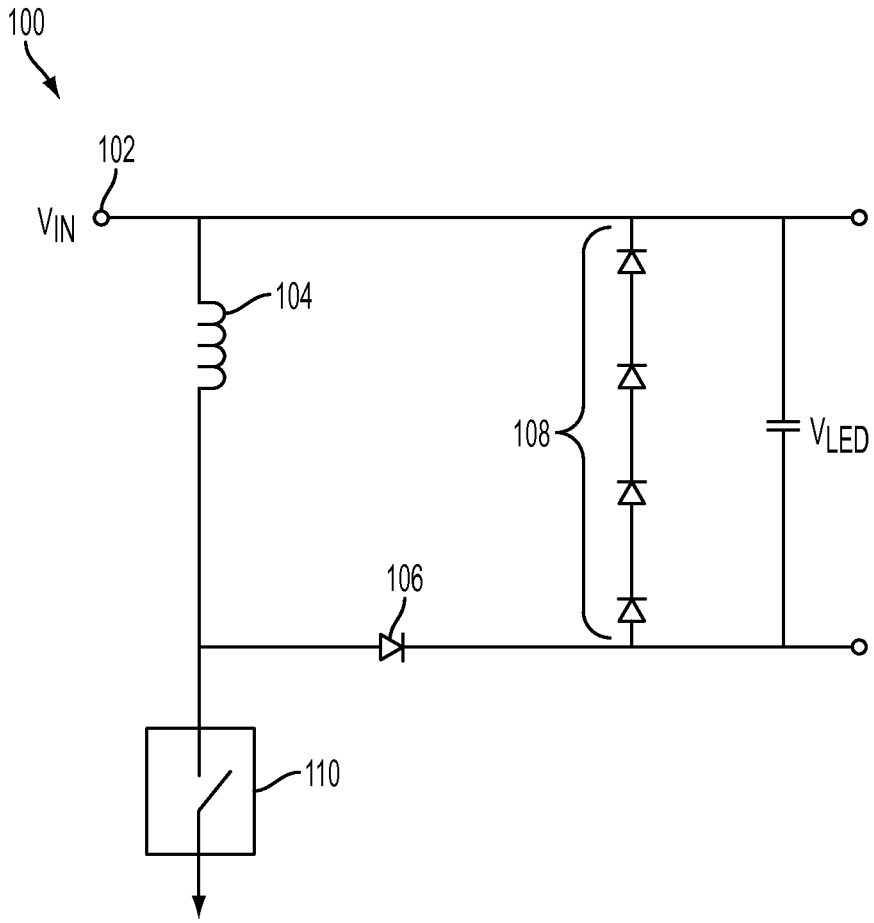
FIG. 1 PRIOR ART
FIG. 1 is an example circuit schematic illustrating a buck-boost power stage for a light-emitting diode (LED)-based bulb in accordance with the prior art.
Figure 2:
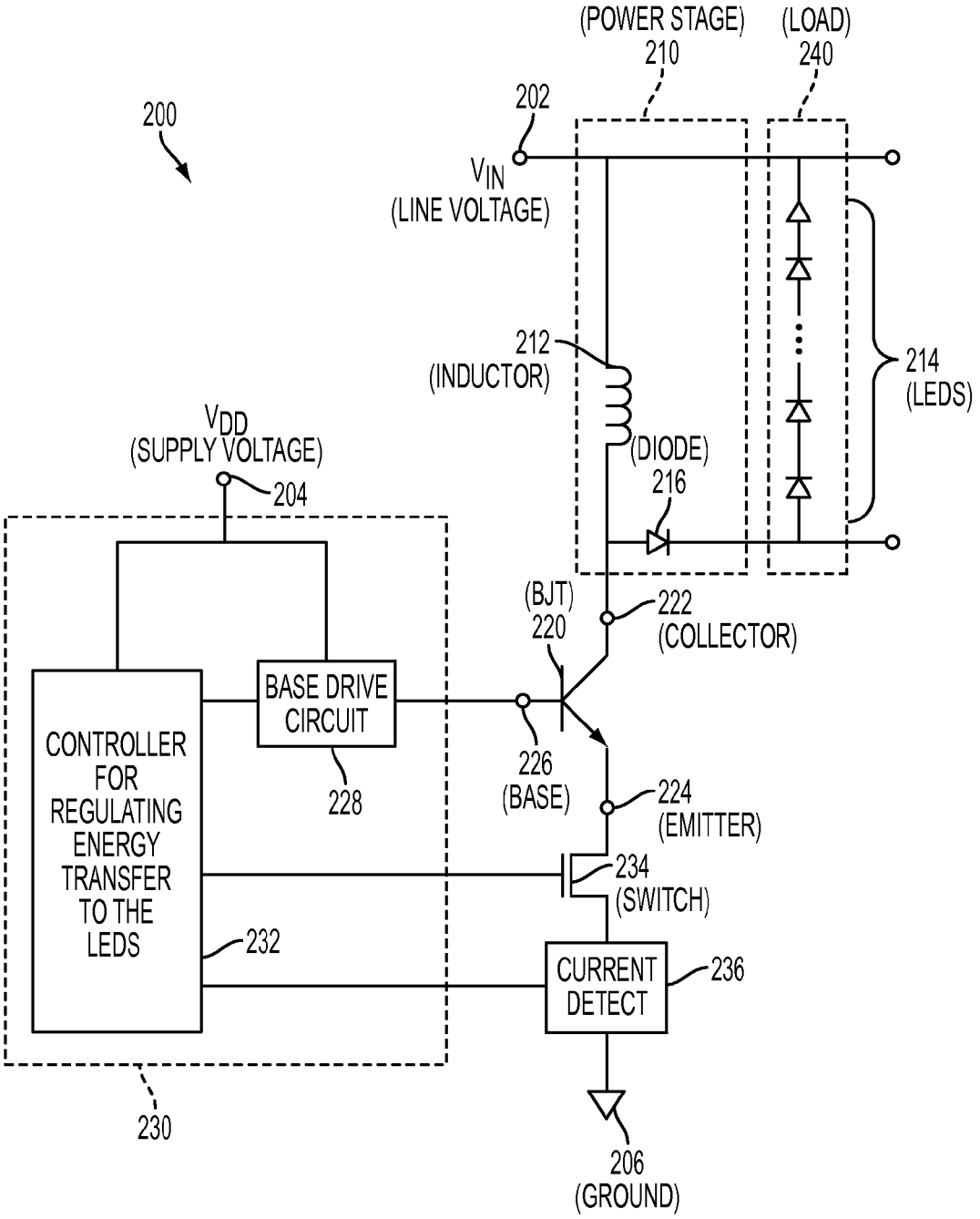
FIG. 2 is an example circuit schematic illustrating a power stage having an emitter-controlled bipolar junction transistor (BJT) according to one embodiment of the disclosure.

FIG. 2 is an example circuit schematic illustrating a power stage having an emitter-controlled bipolar junction transistor (BJT) according to one embodiment of the disclosure. A circuit 200 may include a bipolar junction transistor (BJT) 220 having a collector node 222, an emitter node 224, and a base node 226. The collector 222 may be coupled to a high voltage input node 202 and a lighting load 214, such as a plurality of light emitting diodes (LEDs). An inductor 212 and a diode 216 may be coupled between the high voltage input node 202 and the lighting load 214. The inductor 212 and the diode 216 and other components (not shown) may be part of a power stage 210. The LEDs 214 may generically be any load 240.

Figure 3:
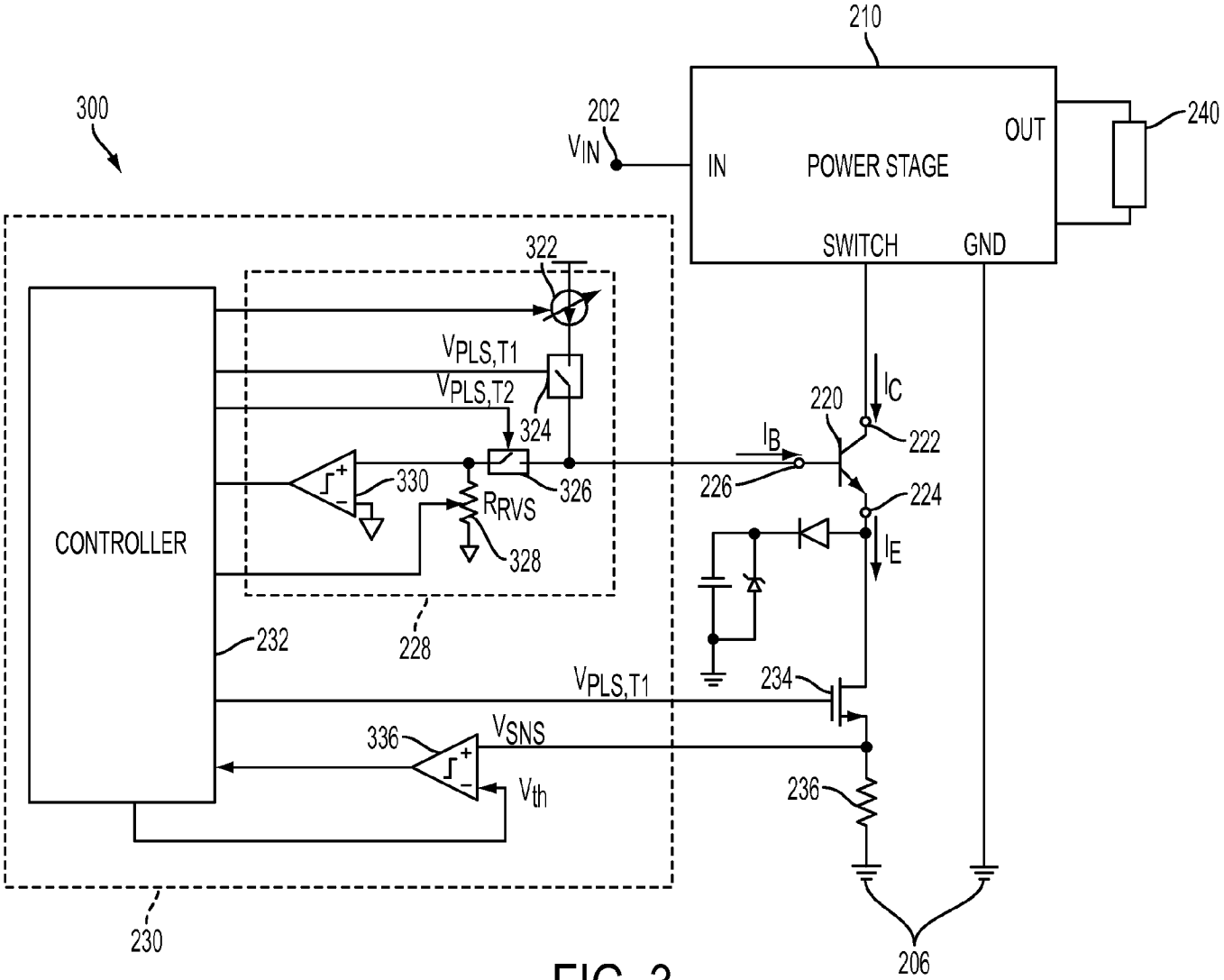
FIG. 3 is an example circuit schematic illustrating control of a bipolar junction transistor (BJT) through two terminals according to one embodiment of the disclosure.

The emitter node 224 of the BJT 220 may be coupled to an integrated circuit (IC) 230 through a switch 234, and a current detect circuit 236. The switch 234 may be coupled in a current path from the emitter node 224 to a ground 206. The current detect circuit 236 may be coupled between the switch 234 and the ground 206. The controller 232 may control power transfer from the input node 202 to the lighting load 214 by operating the switch 234 to couple and/or disconnect the emitter node 224 of the BJT 220 to the ground 206. The current detect circuit 236 may provide feedback to the controller 232 regarding current flowing through the BJT 220 while the switch 234 is turned on to couple the emitter node 224 to the ground 206. As shown in FIG. 3, the switch 234 and the current detect circuit 236, such as a resistor 236, are not part of the IC 230. In another embodiment, the switch 234 and the resistor 236 may be part of the IC 230 and integrated with the controller 232 and other components such as those shown in FIG. 2.

The base node 226 of the BJT 220 may also be coupled to the IC 230, such as through a base drive circuit 228. The base drive circuit 228 may be configured to provide a relatively fixed bias voltage to the base node 226 of the BJT 220, such as during a time period when the switch 234 is switched on. The base drive circuit 228 may also be configured to dynamically adjust base current to the BJT 220 under control of the controller 232. The base drive circuit 228 may be controlled to maintain conduction of the BJT 220 for a first time period. The base drive circuit 228 may be disconnected from the BJT 220 to begin a second flyback time period with the turning off of the BJT 220.

The controller 232 may control delivery of power to the lighting load 214 in part through the switch 234 at the emitter node 224 of the BJT 220. When the controller 232 turns on the switch 234, current flows from the high voltage input node 202, through the inductor 212, the BJT 220, and the switch 234, to the ground 206. During this time period, the inductor 212 charges from electromagnetic fields generated by the current flow. When the controller 232 turns off the switch 234, current flows from the inductor 212, through the diode 216, and through the lighting load 214 after a reverse recovery time period of the BJT 220 completes and a sufficient voltage accumulates at collector node 222 to forward bias diode 216 of the power stage 210. The lighting load 214 is thus powered from the energy stored in the inductor 212, which was stored during the first time period when the controller 232 turned on the switch 234. The controller 232 may repeat the process of turning on and off the switch 234 to control delivery of energy to the lighting load 214. Although the controller 232 operates switch 234 to start a conducting time period for the BJT 220 and to start a turn-off transition of the BJT 220, the controller 232 may not directly control conduction of the BJT 220. Control of delivery of energy from a high voltage source may be possible in the circuit 200 without exposing the IC 230 or the controller 232 to the high voltage source.

The controller 232 may decide the first duration of time to hold the switch 234 on and the second duration of time to hold the switch 234 off based on feedback from the current detect circuit 236. For example, the controller 232 may turn off the switch 234 after the current detect circuit 236 detects current exceeding a first current threshold. A level of current detected by the current detect circuit 236 may provide the controller 232 with information regarding a charge level of the inductor 212. By selecting the first duration of the time and the second duration of time, the controller 232 may regulate an average current output to the LEDs 214. When the current detect circuit 236 is a resistor, the detected current level through the BJT 220 may be calculated based, at least in part, on an estimated or measured resistance of the resistor in current detect circuit 236. Several methods of measuring the approximate resistance of the resistor is described below with reference to FIG. 6, FIG. 7, FIG. 8, and FIG. 9.

Additional example details for one configuration of the IC 230 are shown in FIG. 3. FIG. 3 is a circuit schematic illustrating control of a bipolar junction transistor (BJT) through two terminals according to one embodiment of the disclosure. A circuit 300 may include, within the IC 230, a forward base current source 322 coupled to the base node 226 by a forward base switch 324. The current source 322 may provide a variable base current adjustable by the controller 232. The switch 324 may be switched on by the controller 232 with a control signal $V_{PLS,T1}$. The control signal $V_{PLS,T1}$ may also be applied to the switch 234 at the emitter of the BJT 220. As described above, the switch 234 may be turned on to charge the power stage 210 during a first time period. The switch 324 may also be turned on during the same time period, and current from the source 322 applied to the BJT 220 to allow the BJT 220 to remain turned on and in a conducting state. In one embodiment, the controller 232 may also control the current source 322 to increase a base current to the BJT 220 proportional to an increase in collector current through the BJT 220. The $V_{PLS,T1}$ control signal may be generated by monitoring a current detect resistor 236 with a comparator 336. For example, when the current sensed by resistor 236 reaches a threshold voltage, $V_{th}$, the comparator 336 output may switch states and the controller 232 may then switch a state of the $V_{PLS,T1}$ control signal.

The reverse recovery time period described above may be dynamically adjusted. The adjustments may be based, in part, on a condition, such as voltage level, at a base 226 of the BJT 220. The adjustments may be performed by, for example, controlling the forward base current source 322 of FIG. 3. The reverse recovery time period may also be controlled with a reverse base current source as illustrated in FIG. 4.

Figure 4:
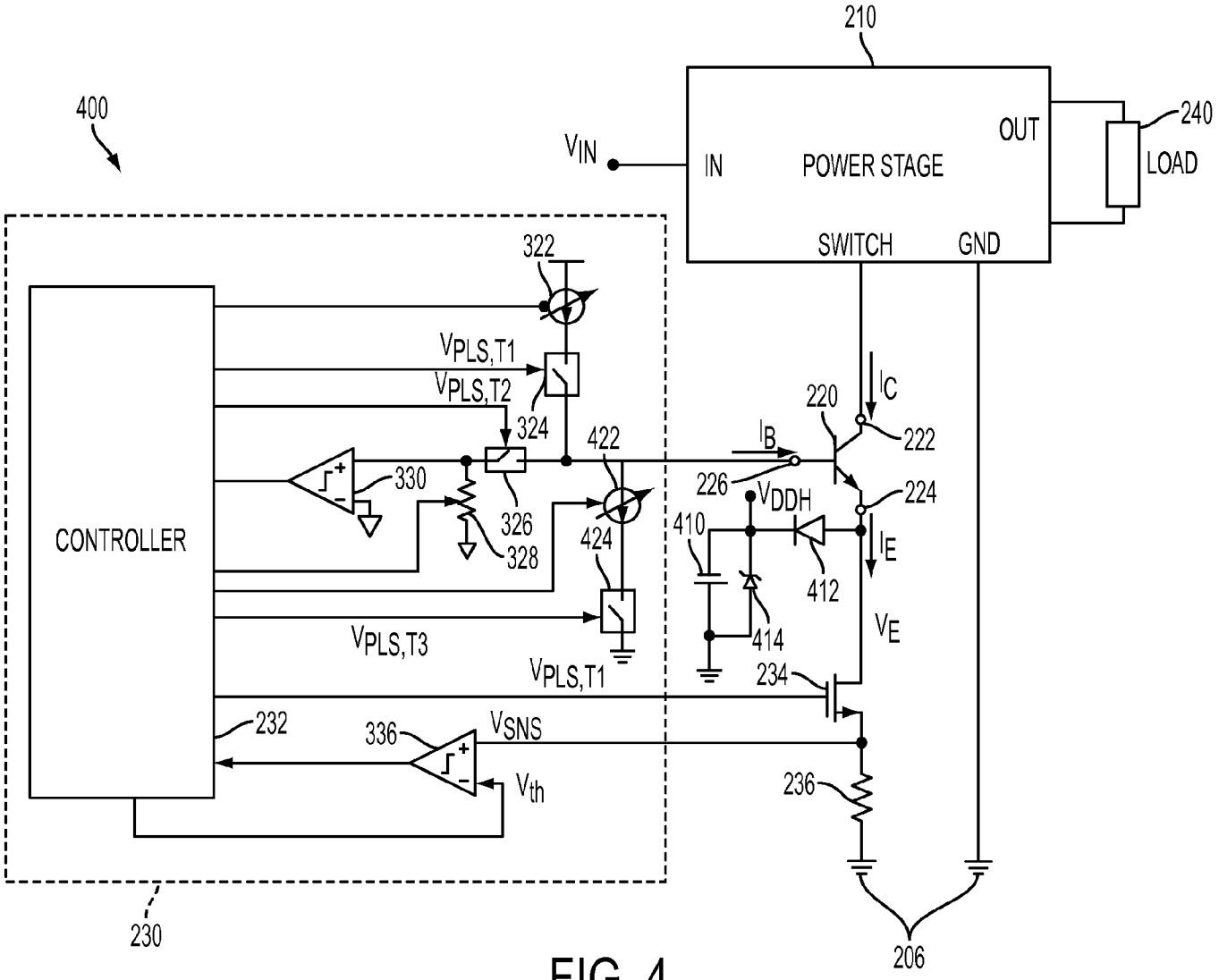
FIG. 4 is an example circuit schematic illustrating control of a bipolar junction transistor (BJT) with a forward and a reverse base current source according to one embodiment of the disclosure.

FIG. 4 is an example circuit schematic illustrating control of a bipolar junction transistor (BJT) with a forward and a reverse base current source according to one embodiment of the disclosure. A circuit 400 may be similar to the circuit 300 of FIG. 3, but may also include a reverse base current source 422 and a second reverse base switch 424. The switch 424 may be controlled by a $V_{PLS,T3}$ control signal generated by the controller 232. The controller 232 may switch on the switch 424 and control the current source 422 during a portion of or the entire reverse recovery time period of the BJT 220 to adjust the duration of the reverse recovery time period. In the circuit 400, the reverse recovery time period may thus be controlled by varying the resistor 328 and/or controlling the current source 422. The use of current source 422 may be advantageous over varying the resistor 328 in certain embodiments by allowing the controller 232 to set a current output level without measuring the base voltage of the BJT 220. For example, the controller 232 may set the current source 422 to a value proportional to the collector current $I_C$ to reduce the reverse recovery time period. In one embodiment, the value may be between approximately 20% and 50% of peak collector current $I_C$.

Information regarding the level of collector current $I_C$ may be obtained from the current detect circuit 236. When the current detect circuit 236 is a resistor, an accurate calculation of the collector current $I_C$ may be improved by having a measured value of the resistor. Several methods of measuring the approximate resistance of the resistor is described below with reference to FIG. 6, FIG. 7, FIG. 8, and FIG. 9.

Figure 5:
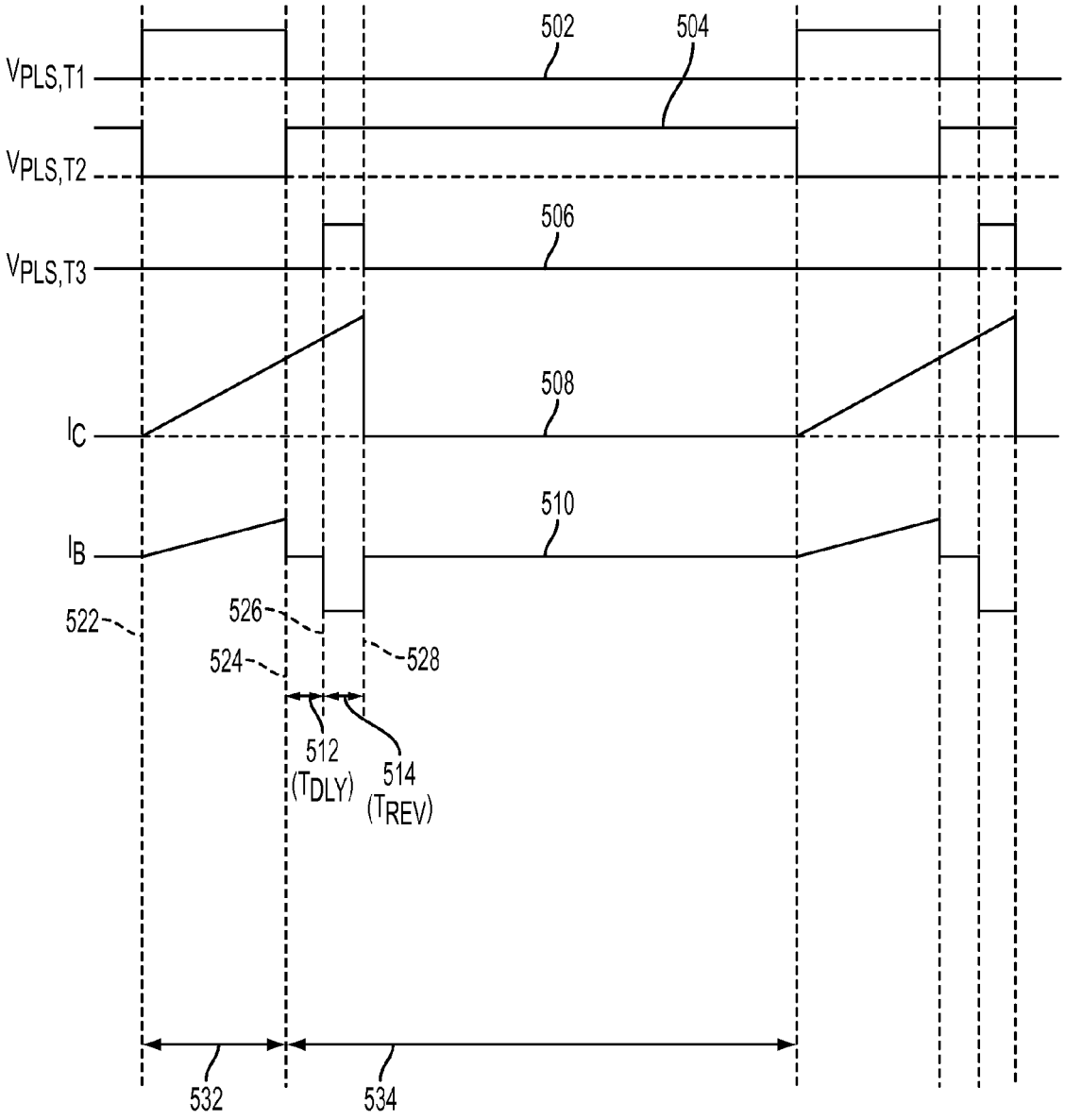
FIG. 5 are example graphs illustrating dynamic adjustment of a reverse recovery period by a controller with a reverse base current source according to one embodiment of the disclosure.

One example of operation of the circuit of FIG. 4 is shown in the graphs of FIG. 5. FIG. 5 are example graphs illustrating dynamic adjustment of a reverse recovery period by a controller with a reverse base current source according to one embodiment of the disclosure. Lines 502, 504, and 506 represent control signals $V_{PLS,T1}$, $V_{PLS,T2}$, and $V_{PLS,T3}$, respectively, generated by the controller 232. At time 522, the $V_{PLS,T1}$ signal switches high and the $V_{PLS,T2}$ signal switches low to turn on the BJT 220. While the BJT 220 is on, the collector current $I_C$ shown in line 508 may linearly increase, and the controller 232 may dynamically adjust a base current $I_B$ shown in line 510 proportionally to the collector current $I_C$. At time 524, the $V_{PLS,T1}$ signal switches low to turn off the base current source and begin turning off of the BJT 220. Also at time 524, the $V_{PLS,T2}$ signal switches high to couple the resistor 328 to the BJT 220 and allow measurement of the reverse base current and thus detection of the end of the reverse recovery time period. The controller 232 may then wait a time period $T_{DLY}$ 512 before switching the $V_{PLS,T3}$ signal to high at time 526 to couple the reverse base current source 422 to the BJT 220. In one embodiment, the current source 422 may be configured by the controller 232 to provide a current of between approximately 10% and 50% of the collector current $I_C$. The controller 232 may hold the $V_{PLS,T3}$ signal high for time period $T_{REV}$ 514 to quickly discharge base charge from the BJT 220 to turn off the BJT 220. Although shown in FIG. 5 as a constant negative base current $I_B$ during time period 514, the negative base current may be varied by the controller 232 adjusting the base current source 422. The controller 232 may then switch the $V_{PLS,T3}$ signal to low when the reverse base current reaches zero, such as may be measured by the sense amplifier 330. After time 528, the controller 232 may wait a delay period before repeating the sequence of times 522, 524, 526, and 528. The controller may repeat first time period 532 and second time period 534 to obtain a desired average current output to a load. Power is output to the load 240 during a portion of the second time period 534 following the reverse recovery time periods 512 and 514. By controlling the durations of the first time period 532, the reverse recovery time periods 512 and 514, and the second time period 534, the controller 232 may regulate the average output current to the load 240.

During the time period $T_{DLY}$ 512, a supply capacitor may be charged from current conducted through the BJT 220 during the reverse recovery time period. For example, a capacitor 410 may be coupled to an emitter node 224 of the BJT 220 through a diode 412 and Zener diode 414. The capacitor 414 may be used, for example, to provide a supply voltage to the controller 232. By adjusting a duration of the time period $T_{DLY}$ 512, the controller 232 may adjust a charge level on the capacitor 410 and thus a supply voltage provided to the controller 232. The controller 232 may maintain the capacitor 410 at a voltage between a high and a low threshold supply voltage to ensure proper operation of the controller 232. Time period $T_{DLY}$ 512 and time period $T_{REV}$ 514 may be modulated almost independently of each other, as long as the supplied base current $I_B$ drives the BJT 220 into saturation. If supply generation is not desired, then time period $T_{DLY}$ may be set to zero without changing the functioning of the rest of the circuit.

In some embodiments of the above circuits, the BJT 220 may have a base-emitter reverse breakdown voltage that must be avoided, such as a breakdown voltage of approximately 7 Volts. Thus, the controller 232 may be configured to ensure that when the base 226 is pulled down by the current source 422, the voltage at the base node 226 and the emitter node 224 may remain below this limit. When the switch 234 is off, the emitter may float to $V_{ddh}+V_d$. If the supply voltage $V_{ddh}$ is close to the breakdown voltage, such as 7 Volts, the base pull down with current source 422 may cause breakdown of the BJT 220. Thus, the controller 232, instead of pulling the base node 226 to ground, may pull the base node 226 to a fixed voltage which ensures the reverse voltage across the base node 226 and the emitter node 224 is less than the breakdown voltage, such as 7 Volts.

Certain parameters of the various circuits presented above may be used by the controller 232 to determine operation of the circuits. That is, the controller 232 may be configured to toggle control signals $V_{PLS,T1}$, $V_{PLS,T2}$, and/or $V_{PLS,T3}$ based on inputs provided from comparators 330 and 336 and/or a measured voltage level $V_{ddh}$. For example, the controller 232 may be configured to operate various components of the circuits based on detecting a beginning of a reverse recovery period. In one embodiment, the beginning of the reverse recovery period may be determined by detecting a signal from the comparator 330 of FIG. 3. In another embodiment, the beginning of the reverse recovery period may be determined by detecting a rise in voltage at the emitter node 224 from $V_{th}$ to $V_{ddh}+V_D$.

In addition to detecting the beginning of the reverse recovery period, the controller 232 may be able to detect an end of the reverse recovery period. In one embodiment while referring back to FIG. 4, the controller 232 may receive an input signal corresponding to a voltage level at the base 226 of the BJT 220. For example, the comparator 330 may be coupled to the base node 226 and output a signal to the controller 232 indicating a difference between the voltage at the base node 226 and a reference voltage. When the $V_{PLS,T1}$ signal goes low, the switch 234 may turn off, but the BJT 220 may not turn off due to stored charge at the base node 226. The voltage at the base node 226 of the BJT 220 may be equal to approximately $V_{DDH}+V_D+V_{BE}$, where $V_{DDH}$ is a voltage across the capacitor 410, $V_D$ is a voltage across the diode 412, and $V_{BE}$ is a voltage between the base node 226 and the emitter node 224. To decrease the turn off time of the BJT 220, the base 226 may be pulled down with a current of between approximately 0.1 $I_C$ and 0.5 $I_C$. As the base charge depletes, the BJT 220 may begin turning off. When the BJT 220 turns off, the voltage at the base node 226 of the BJT 220 may decrease rapidly. This drop in voltage may be sensed using, for example, the comparator 330. In one embodiment, a reference voltage to the comparator 330 may be $V_{ddh}$-2 V and a change of output signal level at the comparator 330 may thus indicate the end of the reverse recovery time.

Figure 6:
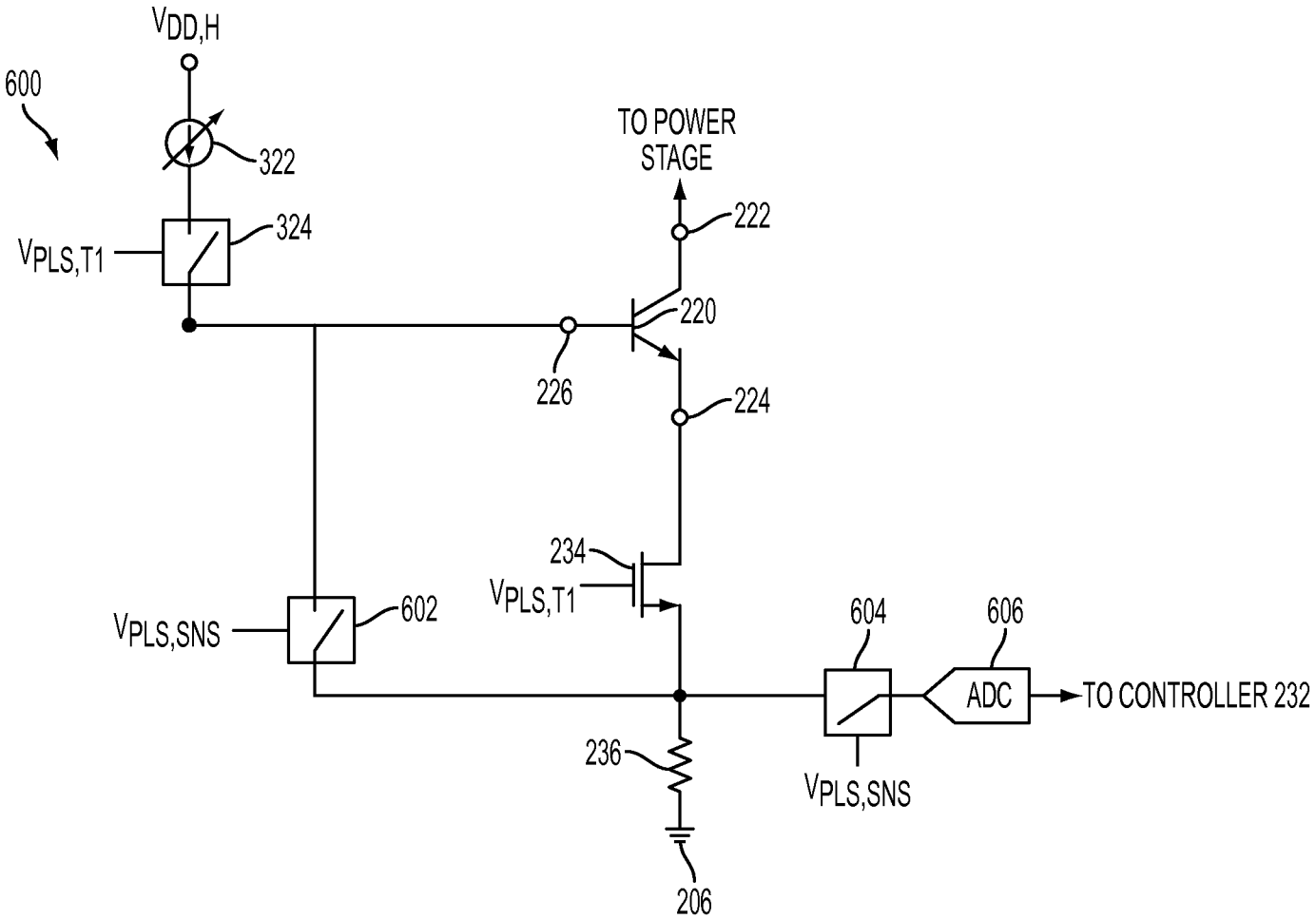
FIG. 6 is an example circuit schematic illustrating a configuration for measuring a resistor with a base current source according to one embodiment of the disclosure.

As described above, when the current detect circuit 236 includes a resistor, the resistor may be measured and the measured resistance used by the controller 232 to determine a duration for the first time period $T_1$ and second time period $T_2$ and/or timing of various control signals including $V_{PLS,T1}$, $V_{PLS,T2}$, $V_{PLS,T3}$, and/or $V_{PLS,T4}$. One example circuit for measuring the resistor 236 is presented in FIG. 6. In one embodiment, a forward base current source, such as source 322 of FIG. 3, coupled to the base of the bipolar junction transistor (BJT) may be used to measure the resistor 236. Although the base current source is shown as a current source throughout the examples, any other dedicated or shared current source may be used to supply a current to resistor 236 for a resistance measurement. FIG. 6 is a circuit schematic illustrating a configuration for measuring a resistor with a base current source according to one embodiment of the disclosure. A circuit 600 may include the switch 324 coupled between the current source 322 and the base node 226 of the BJT 220. A second switch 602 is coupled between the current source 322 and the resistor 236. A third switch 604 may be coupled between the resistor 236 and an analog-to-digital controller (ADC) 606.

A measurement of a resistance value of the resistor 236 may be performed by the controller 232 generating control signals $V_{PLS,T1}$ and $V_{PLS,SNS}$ to close switches 324, 602, and 604 to a conducting state. The controller 232 may then configure the current source 322 to apply a known current value through the switch 324, the switch 602, and the resistor 236 to ground 206. The applied current from the current source 322 generates a voltage across the resistor 236. That voltage may be measured by the ADC 606 and communicated, for example, to the controller 232. The controller 232 may determine the resistance value of the resistor 236 as the result of dividing the measured voltage by the ADC 606 by the current applied by the current source 322.

Figure 7:
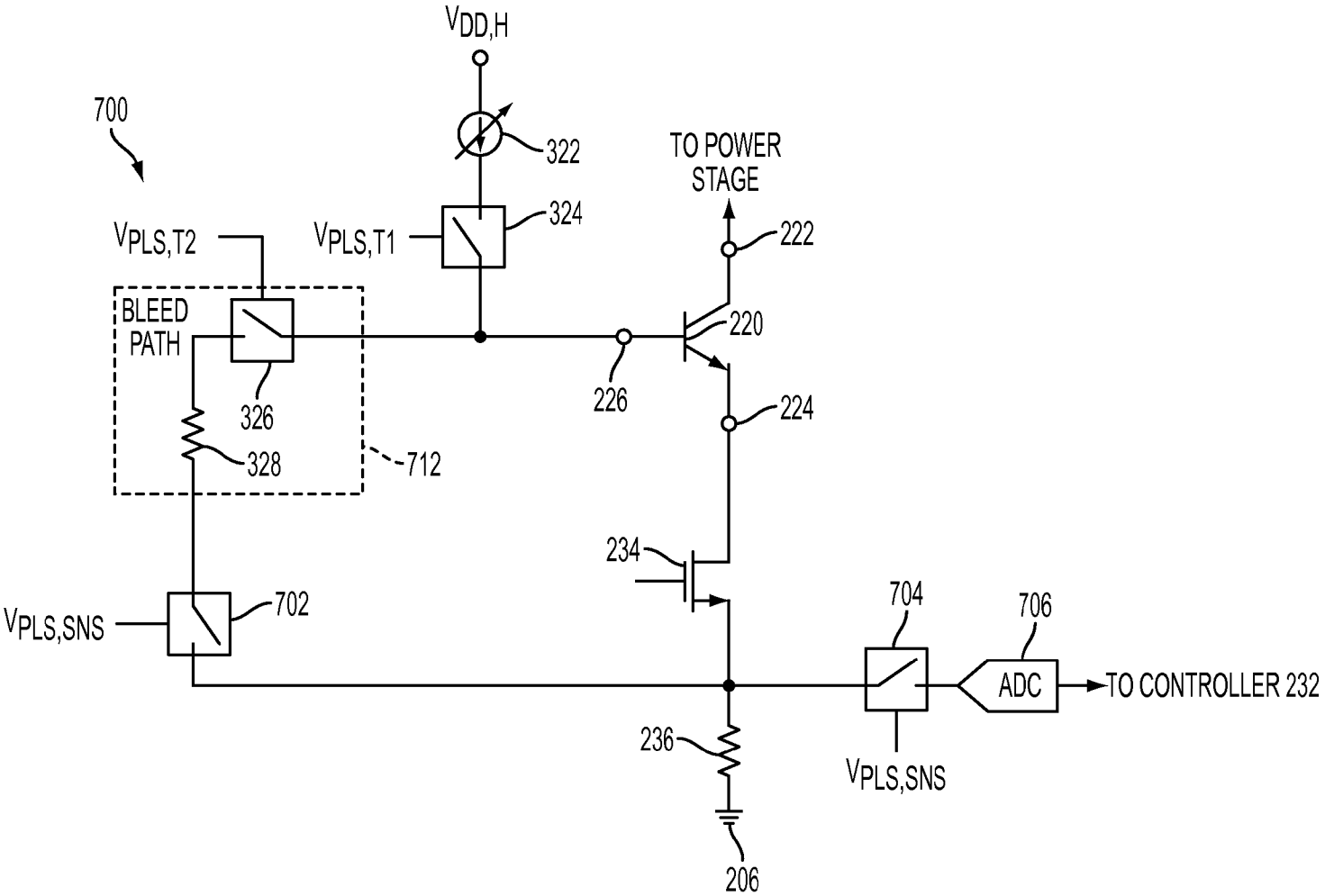
FIG. 7 is an example circuit schematic illustrating another configuration for measuring a resistor with a base current source according to one embodiment of the disclosure.

In another embodiment, the current may be applied to the resistor 236 through the bleed path for the BJT 220 to reduce the number of connections to the base node 226. FIG. 7 is an example circuit schematic illustrating another configuration for measuring a resistor with a base current source according to one embodiment of the disclosure. A circuit 700 includes the switch 324 coupled between the current source 322 and the base node 226 of the BJT 220. A bleed path 712 coupled to the base node 226 may include the switch 326 and the resistor 328. The bleed path 712 may provide a path for bleeding charge from the base node 226 when the current source 322 is disconnected. Circuitry may be coupled to the bleed path 712 to provide for measurements of the resistor 236. That circuitry may include a switch 702 coupled to the resistor 328 and the resistor 236 and a switch 704 coupled to the resistor 236 and an analog-to-digital converter (ADC) 706.

A measurement of a resistance value of the resistor 236 may be performed by the controller 232 by generating control signals $V_{PLS,T1}$, $V_{PLS,T2}$, and $V_{PLS,SNS}$ to close switches 324, 326, 702, and 704 to a conducting state. The controller 232 may then configure the current source 322 to apply a known current value through the switch 324, the switch 326, the switch 702, and the resistor 236 to ground 206. The applied current from the current source 322 generates a voltage across the resistor 236. That voltage may be measured by the ADC 706 and communicated, for example, to the controller 232. The controller 232 may determine the resistance value of the resistor 236 as the result of dividing the measured voltage by the ADC 706 by the current applied by the current source 322.

The circuits 600 and 700 of FIG. 6 and FIG. 7 described above may be implemented for the measurement of resistances within either buck-boost topologies as illustrated in FIG. 2, FIG. 3, and FIG. 4 or flyback topologies, in which a transformer is coupled between the collector node of the BJT 220, the line source, and the load 240 of FIG. 2.

In one embodiment, the controller 232 may perform a measurement of the resistor 236 during a start-up routine of the controller 232. For example, each time an LED-based light bulb is switched on, the controller 232 may measure the resistor 236 before the LED-based light bulb begins emitting light. The measurement may be performed in a very short time period such that the measurement is unnoticeable to a person in the room with the LED-based light bulb.

In another embodiment, the controller 232 may perform the measurement of the resistor 236 at different times during operation of the LED-based light bulb. For example, the controller 232 may perform the measurement at the same time during each line cycle of the line source voltage. As another example, the controller 232 may perform the measurement every 50, 100, or 1000 line cycles. In certain embodiments, the controller 232 may perform the resistance measurement at start-up as described above in addition to in each cycle or after a certain number of cycles.

Figure 8:
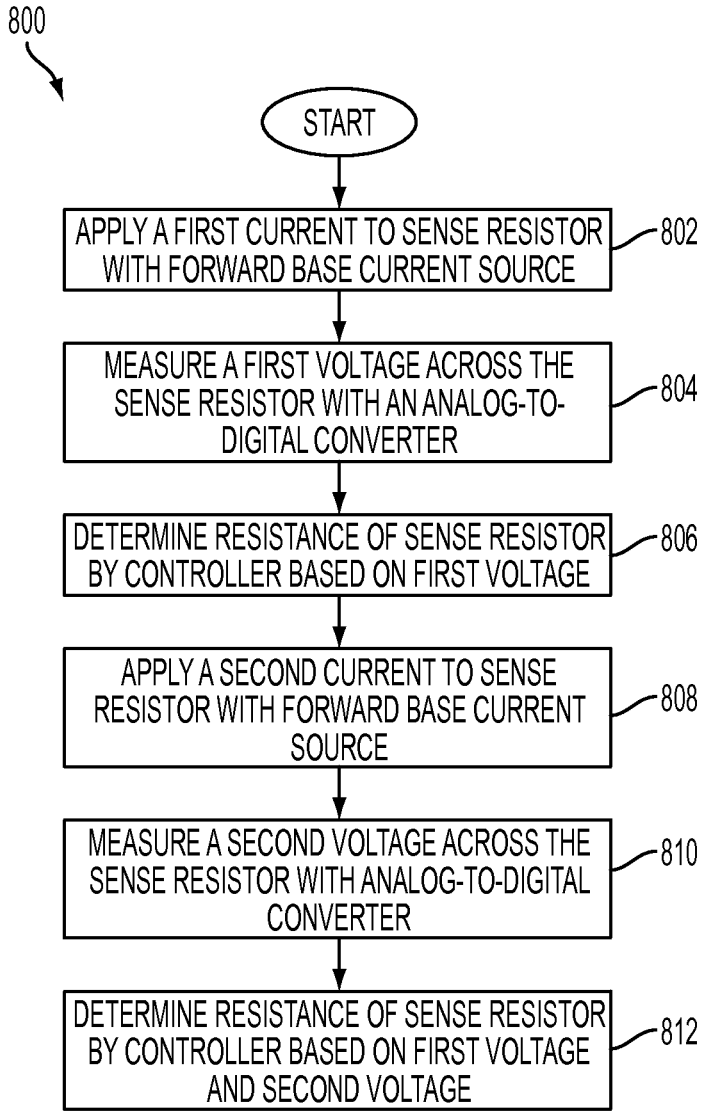
FIG. 8 is an example flow chart illustrating a method of averaging multiple resistance measurements to determine a resistance value of the resistor according to one embodiment of the disclosure.

The resistance measurement of the resistor 236 described above may be improved by taking multiple measurements of the resistor and averaging the measurements to obtain a final measurement of the resistance. FIG. 8 is an example flow chart illustrating a method of averaging multiple resistance measurements to determine a resistance value of the resistor according to one embodiment of the disclosure. A method 800 may begin at block 802 with applying a first current value to a sense resistor from a forward base current source. At block 804, a first voltage across the sense resistor may be measured with an analog-to-digital converter (ADC). At block 806, a controller or other logic circuitry or software may determine a resistance of the sense resistor based on the measured first voltage of block 806.

A process similar to blocks 802 and 804 may be repeated in blocks 808 and 810 to obtain a second resistance value. For example, at block 806, a second current value may be applied to the sense resistor with the forward base current source. The second current value may be the same as the first current value or a different value. At block 810, a second voltage across the sense resistor may be measured with the ADC. Then, at block 812, the results of the first measurement of blocks 802, 804, and 806 and the second measurement of blocks 808 and 810 may be averaged to determine a final resistance value for the resistor 236. For example, the resistance may be determined based on the measured first and second voltage values obtained at blocks 804 and 810. When the first and second current values are different, the resistance at block 812 may be determined on the measured first and second voltage values and the first and second current values applied at blocks 802 and 808.

The measured resistance value, such as obtained from one or two resistance measurements described above and shown in FIG. 8, may be used to control various aspects of the LED-based light bulb. For example, a controller 232, other logic circuitry, and/or software may use the measured resistance value to calculate a current through the BJT 220 of circuits 200, 300, and/or 400. When this current is accurately known, the controller 232 may more accurately be able to regulate energy storage in the inductor 210 and/or control a level of chip supply voltage $V_{DD,H}$. In one embodiment, this control may be obtained by controlling a timing of control signals, such as $V_{PLS,T1}$ supplied to the switch 234. By changing the timing of control signal $V_{PLS,T1}$, the controller 232 may control a ratio between a first time period during which the inductor 210 is charging and a second time period during which the inductor 210 is discharging. The timings of these signals may thus be based, at least in part, on the measured resistance value of the resistor 236.

Further control may be obtained by the controller 232 over the delivery of current to the load 240 by controlling, for example, control signals $V_{PLS,T2}$ and $V_{PLS,T3}$ to control a ratio of a delay time period $T_{DLY}$ and a reverse recovery time period $T_{REV}$. Generation of these control signals may likewise be based on a determined current value through the BJT 220, which may be calculated based, at least in part, on the measured resistance of the resistor 236. Thus, these control signals may also be generated based, at least in part, on the measured resistance. Controlling the ratio of $T_{DLY}$ to $T_{REV}$ may, for example, control delivery of charge to the chip supply voltage $V_{DD,H}$. Additional details regarding the control of the power stage through the use of these control signals is described above with reference to FIG. 5. One embodiment of a method for control of the power stage and thus an LED-based light bulb is shown in FIG. 9.

Figure 9:
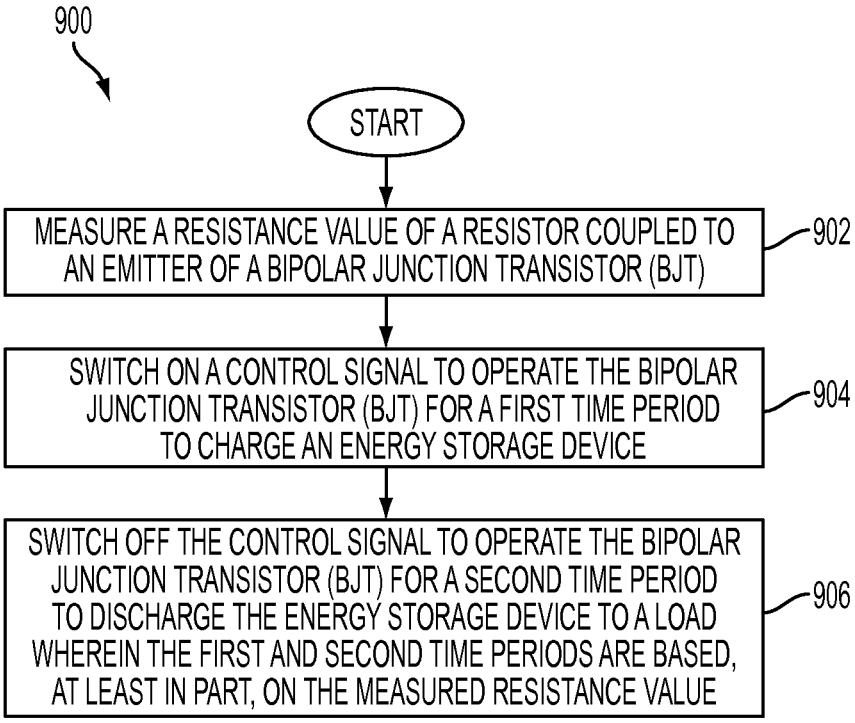
FIG. 9 is an example flow chart illustrating a method of operating a BJT to control a power stage delivering power to a load according to one embodiment of the disclosure.

FIG. 9 is an example flow chart illustrating a method of operating a BJT to control a power stage delivering power to a load according to one embodiment of the disclosure. A method 900 may begin at block 902 with measuring a resistance value of a resistor coupled to an emitter of a bipolar junction transistor (BJT). At block 904, a control signal may be switched on to operate the BJT for a first time period to charge an energy storage device. At block 906, the control signal may be switched off to operate the BJT through a second time period to discharge the energy storage device to a load, such as the LEDs of a LED-based light bulb. The durations of the first and second time period may be determined based, at least in part, on the measured resistance value of block 902.

Figure 10:
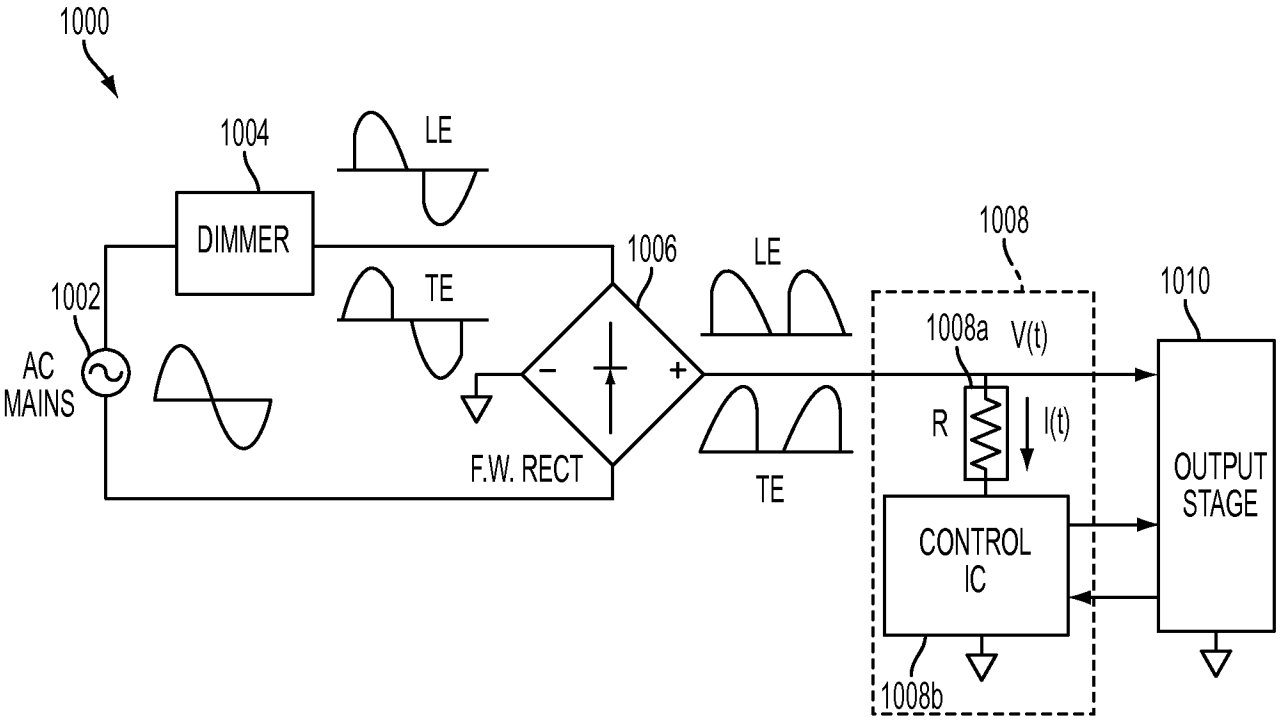
FIG. 10 is an example block diagram illustrating a dimmer system for a light-emitting diode (LED)-based bulb with two terminal drive of a bipolar junction transistor (BJT)-based power stage according to one embodiment of the disclosure.

The circuits described above, including the circuits 200, 300, 400, 600, and/or 700 of FIGS. 2, 3, 4, 6, and 7, respectively, described above may be integrated into a dimmer circuit to provide dimmer compatibility, such as with lighting devices. FIG. 10 is a block diagram illustrating an example dimmer system for a light-emitting diode (LED)-based bulb with two terminal drive of a bipolar junction transistor (BJT)-based power stage according to one embodiment of the disclosure. A system 1000 may include a dimmer compatibility circuit 1008 with a variable resistance device 1008*a* and a control integrated circuit (IC) 1008*b*. The dimmer compatibility circuit 1008 may couple an input stage having a dimmer 1004 and a rectifier 1006 with an output stage 1010, which may include light emitting diodes (LEDs). The system 1000 may receive input from an AC mains line 1002. The output stage 1010 may include a power stage based on a bipolar junction transistor (BJT) as described above. For example, the output stage 1010 may include an emitter-switched bipolar junction transistor (BJT) in the configurations of FIG. 2, FIG. 3, FIG. 4, FIG. 6, or FIG. 7.

If implemented in firmware and/or software, the functions described above, such as with respect to the flow charts of FIG. 8 and FIG. 9 may be stored as one or more instructions or code on a computer-readable medium. Examples include non-transitory computer-readable media encoded with a data structure and computer-readable media encoded with a computer program. Computer-readable media includes physical computer storage media. A storage medium may be any available medium that can be accessed by a computer. By way of example, and not limitation, such computer-readable media can comprise random access memory (RAM), read-only memory (ROM), electrically erasable programmable read-only memory (EEPROM), compact-disc read-only memory (CD-ROM) or other optical disk storage, magnetic disk storage or other magnetic storage devices, or any other medium that can be used to store desired program code in the form of instructions or data structures and that can be accessed by a computer. Disk and disc includes compact discs (CD), laser discs, optical discs, digital versatile discs (DVD), floppy disks and blu-ray discs. Generally, disks reproduce data magnetically, and discs reproduce data optically. Combinations of the above should also be included within the scope of computer-readable media.

In addition to storage on computer readable medium, instructions and/or data may be provided as signals on transmission media included in a communication apparatus. For example, a communication apparatus may include a transceiver having signals indicative of instructions and data. The instructions and data are configured to cause one or more processors to implement the functions outlined in the claims.

Although the present disclosure and certain representative advantages have been described in detail, it should be understood that various changes, substitutions and alterations can be made herein without departing from the spirit and scope of the disclosure as defined by the appended claims. For example, although signals generated by a controller are described throughout as "high" or "low," the signals may be inverted such that "low" signals turn on a switch and "high" signals turn off a switch. Moreover, the scope of the present application is not intended to be limited to the particular embodiments of the process, machine, manufacture, composition of matter, means, methods and steps described in the specification. As one of ordinary skill in the art will readily appreciate from the present disclosure, processes, machines, manufacture, compositions of matter, means, methods, or steps, presently existing or later to be developed that perform substantially the same function or achieve substantially the same result as the corresponding embodiments described herein may be utilized. Accordingly, the appended claims are intended to include within their scope such processes, machines, manufacture, compositions of matter, means, methods, or steps.

What is claimed is:

1. A method, comprising:

measuring a resistance value of a resistor coupled to an emitter of a bipolar junction transistor (BJT) in a power stage;

switching on a control signal to operate the bipolar junction transistor (BJT) for a first time period to charge an energy storage device;

switching off the control signal to operate the bipolar junction transistor (BJT) for a second time period to discharge the energy storage device to a load, wherein the measured resistance value is used to determine the first time period and the second time period; and repeating the steps of the switching on the control signal and the switching off the control signal to operate the bipolar junction transistor (BJT) to output a desired average current to the load.

2. The method of claim 1, wherein measuring the resistance value of the resistor comprises:

activating a switch coupled between a base of the bipolar junction transistor (BJT) and the resistor;

applying a current through the switch to the resistor and to a ground; and measuring a voltage across the resistor at the applied current.

3. The method of claim 2, wherein the step of applying a current comprises applying a current from the forward base drive current source for the bipolar junction transistor (BJT).

4. The method of claim 1, wherein the step of measuring the resistance value of the resistor comprises:

activating a switch coupled between a second resistor and the resistor, wherein the second resistor is coupled to a base of the bipolar junction transistor;

applying a current through the switch to the resistor and to a ground; and measuring a voltage across the resistor at the applied current.

5. The method of claim 4, wherein the step of applying a current comprises applying a current from the forward base drive current source for the bipolar junction transistor (BJT).

6. The method of claim 1, further comprising:

measuring a second resistance value of the resistor; and computing a final resistance value for the resistor as an average of the resistance value and the second resistance value, wherein the final resistance value is used to determine the first time period and the second time period.

7. The method of claim 1, wherein the power stage comprises a flyback topology power stage.

8. The method of claim 1, wherein the power stage comprises a buck-boost topology power stage.

9. The method of claim 1, further comprising calculating a peak current for the bipolar junction transistor (BJT) based, at least in part, on the measured resistance value.

10. The method of claim 1, wherein the step of outputting the desired average current to the load comprises delivering a desired average current to a light emitting diode (LED)-based light bulb.

11. An apparatus, comprising:

an integrated circuit (IC) configured to couple to a bipolar junction transistor (BJT), wherein the integrated circuit (IC) comprises:

a switch configured to couple to an emitter of the bipolar junction transistor (BJT);

a resistor coupled to the switch and to a ground; and a controller coupled to the switch and configured to control delivery of power to a load by operating the switch based, at least in part, on a measured resistance of the resistor, wherein the controller is configured to perform the steps of:

measuring a resistance value of the resistor;

switching on a control signal to activate the switch and operate the bipolar junction transistor (BJT) for a first time period to charge an energy storage device;

switching off the control signal to deactivate the switch and operate the bipolar junction transistor (BJT) for a second time period to discharge the energy storage device to a load, wherein the measured resistance value is used to determine the first time period and the second time period; and repeating the steps of the switching on the control signal and the switching off the control signal to operate the bipolar junction transistor (BJT) to output a desired average current to the load.

12. The apparatus of claim 11, further comprising:

a current source;

a second switch coupled to the resistor and coupled to the current source;

an analog-to-digital converter (ADC); and a third switch coupled to the resistor and the analog-to-digital converter (ADC), wherein the controller is configured to perform the step of measuring the resistance value of the resistor by performing the steps of:

activating the second switch and the third switch to apply a current from the current source to the resistor; and receiving a measurement of a voltage across the resistor from the analog-to-digital converter (ADC).

13. The apparatus of claim 12, wherein the current source comprises a forward base current source configured to couple to a base of the bipolar junction transistor (BJT).

14. The apparatus of claim 11, further comprising:

a bleed path configured to couple to a base of the bipolar junction transistor (BJT);

a current source;

a second switch coupled to the bleed path and coupled to the resistor;

an analog-to-digital converter (ADC); and a third switch coupled to the resistor and coupled to the analog-to-digital converter (ADC), wherein the controller is configured to perform the step of measuring the resistance value of the resistor by performing the steps of:

activating the second switch and the third switch to apply a current from the current source to the resistor; and receiving a measurement of a voltage across the resistor from the analog-to-digital converter (ADC).

15. The apparatus of claim 14, wherein the current source comprises a forward base current source configured to couple to a base of the bipolar junction transistor (BJT).

16. The apparatus of claim 11, wherein the controller is further configured to perform the steps of:

measuring a second resistance value of the resistor; and computing a final resistance value for the resistor as an average of the resistance value and the second resistance value, wherein the final resistance value is used to determine the first time period and the second time period.

17. The apparatus of claim 11, wherein the apparatus comprises a flyback topology power stage.

18. The apparatus of claim 11, wherein the apparatus comprises a buck-boost topology power stage.

19. The apparatus of claim 11, wherein the controller is further configured to perform the step of calculating a peak current for the bipolar junction transistor (BJT) based, at least in part, on the measured resistance value.

20. The apparatus of claim 11, wherein the step of outputting the desired average current to the load comprises delivering a desired average current to a plurality of LEDs.

21. An apparatus, comprising:

a lighting load comprising a plurality of light emitting diodes (LEDs);

a bipiolar junction transistor (BJT) comprising a base, an emitter, and a collector, wherein the collector of the bipolar junction transistor (BJT) is coupled to an input node; and an integrated circuit (IC) configured to couple to the bipolar junction transistor (BJT) through the base and the emitter, wherein the integrated circuit (IC) comprises:

a switch configured to couple to the emitter of the bipolar junction transistor (BJT);

a resistor coupled to the switch and to a ground;

an analog-to-digital converter (ADC) coupled to the resistor; and a controller coupled to the switch and configured to:

measure a resistance of the resistor through the analog-to-digital converter (ADC); and control delivery of power to the lighting load by operating the switch based, at least in part, on the measured resistance of the resistor.

22. The apparatus of claim 21, wherein the integrated circuit (IC) further comprises:

a current source;

a second switch coupled to the resistor and coupled to the current source;

a third switch coupled to the resistor and the analog-to-digital converter (ADC), wherein the controller is configured to perform the step of measuring the resistance value of the resistor by performing the steps of:

activating the second switch and the third switch to apply a current from the current to the resistor; and receiving a measurement of a voltage across the resistor from the analog-to-digital converter (ADC).

23. The apparatus of claim 22, wherein the current source comprises a forward base current source configured to couple to a base of the bipolar junction transistor (BJT).

24. The apparatus of claim 21, wherein the integrated circuit (IC) further comprises:

a bleed path configured to couple to a base of the bipolar junction transistor (BJT);

a current source;

a second switch coupled to the bleed path and coupled to the resistor; and a third switch coupled to the resistor and coupled to the analog-to-digital converter (ADC), wherein the controller is configured to perform the step of measuring the resistance value of the resistor by performing the steps of:

activating the second switch and the third switch to apply a current from the current source to the resistor; and receiving a measurement of a voltage across the resistor from the analog-to-digital converter (ADC).

25. The apparatus of claim 24, wherein the current source comprises a forward base current source configured to couple to a base of the bipolar junction transistor (BJT).

* * * * *